US012276470B2

(12) United States Patent
Gomez

(10) Patent No.: US 12,276,470 B2
(45) **Date of Patent: *Apr. 15, 2025**

(54) FIREARM RECEIVER ASSEMBLY

(71) Applicant: LWRC International LLC, Cambridge, MD (US)

(72) Inventor: Jesus S. Gomez, Trappe, MD (US)

(73) Assignee: LWRC International LLC, Cambridge, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/214,493

(22) Filed: Jun. 26, 2023

(65) Prior Publication Data

US 2023/0349658 A1 Nov. 2, 2023

Related U.S. Application Data

(63) Continuation of application No. 17/152,768, filed on Jan. 19, 2021, now Pat. No. 11,686,548, which is a continuation of application No. 16/277,506, filed on Feb. 15, 2019, now Pat. No. 10,895,430, which is a continuation of application No. 15/589,708, filed on (Continued)

(51) Int. Cl.

| | |
|---|---|
| ***F41A 21/48*** | (2006.01) |
| ***F41A 3/66*** | (2006.01) |
| ***F41A 5/18*** | (2006.01) |
| ***F41A 21/00*** | (2006.01) |

(Continued)

(52) U.S. Cl.

CPC ..... *F41A 21/48* (2013.01); *F41A 3/66* (2013.01); *F41A 5/18* (2013.01); *F41A 21/00* (2013.01); *F41A 21/487* (2013.01); *F41C 23/16* (2013.01); *F41C 23/20* (2013.01)

(58) Field of Classification Search

CPC ..... F41C 23/16; F41C 23/10; F41C 27/00; F41C 21/48; F41C 11/02

See application file for complete search history.

(56) References Cited

U.S. PATENT DOCUMENTS

| | | |
|---|---|---|
| 16,277 A | 12/1856 | Heckendorn |
| 16,916 A | 3/1857 | Gardiner |

(Continued)

FOREIGN PATENT DOCUMENTS

| | | |
|---|---|---|
| WO | WO-95/08090 | 3/1995 |
| WO | WO-2008/108804 | 9/2008 |

OTHER PUBLICATIONS

U.S. Appl. No. 11/188,734, dated Aug. 10, 2007, Notice of Allowance in the U.S. Patent and Trademark Office.

(Continued)

*Primary Examiner* — Benjamin P Lee

(74) *Attorney, Agent, or Firm* — Arnall Golden Gregory LLP

(57) ABSTRACT

An upper receiver assembly for a firearm having an upper receiver with an integral barrel nut, a handguard assembly and a barrel nut assembly with a barrel and lock nut is provided. The barrel is received by the upper receiver and is secured directly to the upper receiver using the lock nut. The upper receiver also includes an integral handguard mounting member to which the handguard assembly may be directly attached. The upper receiver assembly allows the user to attach both the barrel and handguard assemblies directly to the upper receiver, independently of one another.

16 Claims, 20 Drawing Sheets

Related U.S. Application Data

May 8, 2017, now Pat. No. 10,240,883, which is a continuation of application No. 14/844,886, filed on Sep. 3, 2015, now Pat. No. 9,772,150, which is a continuation of application No. 13/562,663, filed on Jul. 31, 2012, now Pat. No. 9,140,506.

(51) Int. Cl.
*F41C 23/16* (2006.01)
*F41C 23/20* (2006.01)

(56) References Cited

U.S. PATENT DOCUMENTS 994,530 A 7/1908 Punches
1,348,702 A 8/1920 Gabbett-Fairfax
1,348,733 A 8/1920 Pedersen
1,384,161 A 7/1921 Schwinzer
1,568,005 A 12/1925 Sutter
1,737,974 A 12/1929 Pedersen
1,797,951 A 3/1931 Gaidos
1,994,489 A 3/1935 Simpson
2,090,656 A 8/1937 Williams
2,100,410 A 11/1937 Pugsley
2,137,491 A 11/1938 Huff
2,275,213 A 3/1942 Wise
2,336,146 A 12/1943 Williams
2,377,692 A 6/1945 Johnson, Jr.
2,424,194 A 7/1947 Sampson et al.
2,426,563 A 8/1947 Patchett
2,482,758 A 9/1949 Gaidos
2,532,794 A 12/1950 Teece
2,611,297 A 9/1952 Simpson
2,655,754 A 10/1953 Brush
2,858,741 A 11/1958 Simpson
2,872,849 A 2/1959 Simpson
2,910,795 A 11/1959 Agren
2,952,934 A 9/1960 Yovanovitch
2,971,441 A 2/1961 Reed
3,027,672 A 4/1962 Sullivan
3,137,958 A 6/1964 Lewis et al.
3,176,424 A 4/1965 Hoge
3,198,076 A 8/1965 Stoner
3,301,133 A 1/1967 Sturtevant
3,366,011 A 1/1968 Sturtevant
3,446,114 A 5/1969 Ketterer
3,453,762 A 7/1969 Fremont
3,570,162 A 3/1971 Suddarth
3,618,455 A 11/1971 Plumer et al.
3,618,457 A 11/1971 Miller
3,630,119 A 12/1971 Perrine
3,636,647 A 1/1972 Goldin
3,675,534 A 7/1972 Beretta
3,771,415 A 11/1973 Into et al.
3,776,095 A 12/1973 Atchisson
3,803,739 A 4/1974 Haines et al.
3,857,323 A 12/1974 Ruger et al.
3,869,961 A 3/1975 Kawamura
3,977,296 A 8/1976 Silsby et al.
4,016,667 A 4/1977 Forbes
4,028,993 A 6/1977 Reynolds
4,057,003 A 11/1977 Atchisson
4,128,042 A 12/1978 Atchisson
4,226,041 A 10/1980 Goodworth
4,231,177 A 11/1980 Foote
4,244,273 A 1/1981 Langendorfer, Jr. et al.
4,246,830 A 1/1981 Krieger
4,279,191 A 7/1981 Johansson
4,416,186 A 11/1983 Sullivan
4,433,610 A 2/1984 Tatro
4,475,437 A 10/1984 Sullivan
4,502,367 A 3/1985 Sullivan
4,503,632 A 3/1985 Cuevas
4,505,182 A 3/1985 Sullivan
4,553,469 A 11/1985 Atchisson
4,563,937 A 1/1986 White
H107 H 8/1986 Bauer
D285,236 S 8/1986 Brunton
4,654,993 A 4/1987 Atchisson
4,658,702 A 4/1987 Tatro
4,663,875 A 5/1987 Tatro
4,677,897 A 7/1987 Barrett
4,688,344 A 8/1987 Kim
4,693,170 A 9/1987 Atchisson
4,702,146 A 10/1987 Ikeda et al.
4,735,007 A 4/1988 Gal
4,765,224 A 8/1988 Morris
4,872,279 A 10/1989 Boat
4,893,426 A 1/1990 Bixler
4,893,547 A 1/1990 Atchisson
5,038,666 A 8/1991 Major
5,117,735 A 6/1992 Flashkes
5,173,564 A 12/1992 Hammond, Jr.
5,183,959 A 2/1993 McCoan et al.
5,198,600 A 3/1993 E'Nama
5,272,956 A 12/1993 Hudson
5,343,650 A 9/1994 Swan
5,351,598 A 10/1994 Schuetz
5,412,895 A 5/1995 Krieger
5,448,940 A 9/1995 Schuetz et al.
5,452,534 A 9/1995 Lambie
5,551,179 A 9/1996 Young
5,565,642 A 10/1996 Heitz
5,590,484 A 1/1997 Mooney et al.
5,634,288 A 6/1997 Martel
5,678,343 A 10/1997 Menges et al.
5,726,377 A 3/1998 Harris et al.
5,770,814 A 6/1998 Ealovega
5,806,224 A 9/1998 Hager
5,826,363 A 10/1998 Olson
5,827,992 A 10/1998 Harris et al.
5,900,577 A 5/1999 Robinson et al.
5,907,919 A 6/1999 Keeney
6,019,024 A 2/2000 Robinson et al.
6,070,352 A 6/2000 Daigle
6,071,523 A 6/2000 Mehta et al.
6,134,823 A 10/2000 Griffin
6,182,389 B1 2/2001 Lewis
6,227,098 B1 5/2001 Mason
6,311,603 B1 11/2001 Dunlap
6,382,073 B1 5/2002 Beretta
6,418,655 B1 7/2002 Kay
6,508,027 B1 1/2003 Kim
6,536,153 B2 3/2003 Lindsey
6,564,492 B2 5/2003 Weldle et al.
6,606,812 B1 8/2003 Gwinn, Jr.
6,634,274 B1 10/2003 Herring
6,651,371 B2 11/2003 Fitzpatrick et al.
6,655,069 B2 12/2003 Kim
6,655,372 B1 12/2003 Field et al.
6,668,815 B1 12/2003 Fernandez
6,671,990 B1 1/2004 Booth
6,681,677 B2 1/2004 Herring
6,718,680 B2 4/2004 Roca et al.
6,722,255 B2 4/2004 Herring
6,761,101 B1 7/2004 Luth
6,792,711 B2 9/2004 Battaglia
6,820,533 B2 11/2004 Schuerman
6,829,974 B1 12/2004 Gwinn, Jr.
6,848,351 B1 2/2005 Davies
6,851,346 B1 2/2005 Herring
6,901,691 B1 6/2005 Little
6,945,154 B1 9/2005 Luth
6,959,509 B2 11/2005 Vais
6,971,202 B2 12/2005 Bender
7,036,259 B2 5/2006 Beretta
7,082,709 B2 8/2006 Lindsey
7,131,228 B2 11/2006 Hochstrate et al.
7,137,217 B2 11/2006 Olson et al.
7,162,822 B1 1/2007 Heayn et al.
7,213,498 B1 5/2007 Davies
7,216,451 B1 5/2007 Troy
7,219,462 B2 5/2007 Finn
7,231,861 B1 6/2007 Gauny et al.
7,243,453 B2 7/2007 McGarry

(56) References Cited

U.S. PATENT DOCUMENTS 7,299,737 B2 11/2007 Hajjar et al.
7,313,883 B2 1/2008 Leitner-Wise
7,316,091 B1 1/2008 Desomma
7,398,616 B1 7/2008 Weir
7,428,795 B2 9/2008 Herring
7,444,775 B1 11/2008 Schuetz
7,461,581 B2 12/2008 Leitner-Wise
7,478,495 B1 1/2009 Alzamora et al.
7,497,044 B2 3/2009 Cammenga et al.
D590,473 S 4/2009 Fitzpatrick et al.
7,523,580 B1 4/2009 Tankersley
7,533,598 B1 5/2009 Murphy
D603,012 S 10/2009 Fitzpatrick et al.
7,596,900 B2 10/2009 Robinson et al.
7,634,959 B2 12/2009 Frickey
7,661,219 B1 2/2010 Knight, Jr. et al.
7,698,844 B2 4/2010 Gruber et al.
7,707,762 B1 5/2010 Swan
7,715,865 B2 5/2010 Camp, Jr.
7,716,865 B2 5/2010 Daniel et al.
7,735,410 B2 6/2010 Clark
7,743,542 B1 6/2010 Novak
7,762,018 B1 7/2010 Fitzpatrick et al.
7,775,150 B2 8/2010 Hochstrate et al.
7,784,211 B1 8/2010 Desomma
7,793,453 B1 9/2010 Sewell, Jr. et al.
7,806,039 B1 10/2010 Gomez
7,827,722 B1 11/2010 Davies
7,832,326 B1 11/2010 Barrett
7,886,470 B1 2/2011 Doiron
D636,043 S 4/2011 Olsen et al.
7,930,968 B2 4/2011 Giefing
7,963,203 B1 6/2011 Davies
7,966,760 B2 6/2011 Fitzpatrick et al.
7,966,761 B1 6/2011 Kuczynko et al.
D641,451 S 7/2011 Gomez et al.
7,975,595 B2 7/2011 Robinson et al.
8,037,806 B2 10/2011 Davies
8,051,595 B2 11/2011 Hochstrate et al.
8,056,460 B2 11/2011 Herring
8,061,072 B1 11/2011 Crose
8,069,604 B2 12/2011 Larue
8,109,193 B2 2/2012 Herring
8,141,285 B2 3/2012 Brown
8,141,289 B2 3/2012 Gomez et al.
8,181,563 B1 5/2012 Peterken
8,186,090 B1 5/2012 Chiarolanza et al.
8,209,896 B1 7/2012 Cashwell
8,230,634 B1 * 7/2012 Davies ..... F41G 11/003 42/75.02
8,234,808 B2 8/2012 Lewis et al.
8,245,427 B2 8/2012 Gomez
8,245,429 B2 8/2012 Kuczynko et al.
D668,311 S 10/2012 Rogers et al.
8,296,984 B2 10/2012 Kincel
8,307,750 B2 11/2012 Vuksanovich et al.
D674,859 S 1/2013 Robbins et al.
8,341,868 B2 1/2013 Zusman
8,342,075 B2 1/2013 Gomez
8,375,616 B2 2/2013 Gomez et al.
8,387,513 B2 3/2013 Gomez et al.
8,393,107 B2 3/2013 Brown
8,397,415 B2 3/2013 Laney et al.
8,418,389 B1 4/2013 Lukman et al.
8,434,252 B2 5/2013 Holmberg
8,468,929 B2 6/2013 Larson et al.
8,479,429 B2 7/2013 Barrett et al.
8,516,731 B2 8/2013 Cabahug et al.
8,539,708 B2 9/2013 Kenney et al.
8,561,335 B2 10/2013 Brown
8,631,601 B2 1/2014 Langevin et al.
8,689,477 B2 4/2014 Gomez et al.
8,689,672 B2 4/2014 Cassels
8,726,559 B1 5/2014 Mueller
8,746,125 B2 6/2014 Gomez et al.
8,769,855 B2 7/2014 Law
8,783,159 B2 7/2014 Gomez et al.
8,806,792 B2 8/2014 Yan et al.
8,806,793 B2 8/2014 Daniel et al.
D712,998 S 9/2014 Gomez
8,844,424 B2 9/2014 Gomez
8,863,426 B1 10/2014 Zinsner
8,887,426 B2 11/2014 Feese et al.
8,899,142 B1 12/2014 Cassels
8,943,947 B2 2/2015 Gomez
8,950,312 B2 2/2015 Gomez
8,955,422 B1 2/2015 Schumacher
8,966,800 B1 3/2015 Olsor
8,978,284 B1 3/2015 Zusman
9,010,009 B2 4/2015 Buxton
9,038,304 B1 5/2015 Hu
D735,288 S 7/2015 Gomez
9,103,611 B2 8/2015 Neitzling
9,121,663 B2 9/2015 Troy et al.
9,140,506 B2 9/2015 Gomez
9,234,713 B1 1/2016 Olson
9,261,324 B1 2/2016 Liang et al.
9,278,432 B1 3/2016 Doto
9,291,414 B2 3/2016 Gomez
9,297,609 B2 3/2016 Burt
9,316,459 B2 4/2016 Troy et al.
9,347,738 B1 5/2016 Schumacher
9,395,148 B1 7/2016 Huang
9,404,708 B1 8/2016 Chow et al.
9,506,702 B2 11/2016 Visinski et al.
9,506,711 B2 11/2016 Gomez
9,625,232 B2 4/2017 Gomez
9,658,011 B2 5/2017 Gomez
9,766,034 B2 9/2017 Huang et al.
9,772,150 B2 9/2017 Gomez
9,810,495 B2 11/2017 Gomez
9,816,546 B2 11/2017 Gomez
9,857,129 B1 1/2018 Kelly et al.
9,915,497 B2 3/2018 Gomez
10,054,394 B2 8/2018 Jen et al.
10,060,699 B1 8/2018 Hu
10,240,883 B2 3/2019 Gomez
10,309,739 B2 6/2019 Gomez
10,323,891 B1 6/2019 Zheng
10,495,402 B2 12/2019 Morris et al.
10,532,447 B2 1/2020 Hamby
10,591,245 B2 3/2020 Gomez
10,690,425 B2 6/2020 Cassels
10,808,748 B2 10/2020 Gomez
2003/0089014 A1 5/2003 Schuerman
2003/0101631 A1 6/2003 Fitzpatrick et al.
2003/0110675 A1 6/2003 Garrett et al.
2003/0126781 A1 7/2003 Herring
2003/0136041 A1 7/2003 Herring
2004/0020092 A1 2/2004 Christensen
2004/0049964 A1 3/2004 Vais
2004/0055200 A1 3/2004 Fitzpatrick et al.
2005/0011345 A1 1/2005 Herring
2005/0011346 A1 1/2005 Wolff et al.
2005/0016374 A1 1/2005 Pescini
2005/0115140 A1 6/2005 Little
2005/0183310 A1 8/2005 Finn
2005/0183317 A1 8/2005 Finn
2005/0188590 A1 9/2005 Baber et al.
2005/0223613 A1 10/2005 Bender
2005/0262752 A1 12/2005 Robinson et al.
2006/0026883 A1 2/2006 Hochstrate et al.
2006/0065112 A1 3/2006 Kuczynko et al.
2006/0283067 A1 12/2006 Herring
2007/0012169 A1 1/2007 Gussalli Beretta et al.
2007/0033850 A1 2/2007 Murello et al.
2007/0033851 A1 2/2007 Hochstrate et al.
2007/0051236 A1 3/2007 Groves et al.
2007/0199435 A1 8/2007 Hochstrate et al.
2007/0234897 A1 10/2007 Poff
2008/0016684 A1 1/2008 Olechnowicz et al.
2008/0029076 A1 2/2008 Liang
2008/0092422 A1 4/2008 Daniel et al.
2008/0092733 A1 4/2008 Leitner-Wise et al.

(56) References Cited

U.S. PATENT DOCUMENTS

| | | | |
|---|---|---|---|
| 2008/0276797 | A1 | 11/2008 | Leitner-Wise |
| 2009/0000173 | A1 | 1/2009 | Robinson et al. |
| 2009/0007477 | A1 | 1/2009 | Robinson et al. |
| 2009/0026679 | A1 | 1/2009 | Harman, III |
| 2009/0031606 | A1 | 2/2009 | Robinson et al. |
| 2009/0031607 | A1 | 2/2009 | Robinson et al. |
| 2009/0107023 | A1 | 4/2009 | Murphy |
| 2009/0151213 | A1 | 6/2009 | Bell |
| 2009/0178325 | A1 | 7/2009 | Veilleux |
| 2010/0071246 | A1 | 3/2010 | Vesligai |
| 2010/0122483 | A1 | 5/2010 | Clark |
| 2010/0126054 | A1 | 5/2010 | Daniel et al. |
| 2010/0154275 | A1 | 6/2010 | Faifer |
| 2010/0162604 | A1 | 7/2010 | Dubois |
| 2010/0186276 | A1 | 7/2010 | Herring |
| 2010/0205846 | A1 | 8/2010 | Fitzpatrick et al. |
| 2010/0236394 | A1 | 9/2010 | Gomez |
| 2010/0242334 | A1 | 9/2010 | Kincel |
| 2010/0269682 | A1 | 10/2010 | Vuksanovich et al. |
| 2010/0281734 | A1 | 11/2010 | Rousseau et al. |
| 2010/0287808 | A1 | 11/2010 | King |
| 2010/0313459 | A1 | 12/2010 | Gomez |
| 2010/0319231 | A1 | 12/2010 | Stone et al. |
| 2010/0319527 | A1 | 12/2010 | Giefing |
| 2011/0005384 | A1 | 1/2011 | Lewis et al. |
| 2011/0016762 | A1 | 1/2011 | Davies |
| 2011/0061281 | A1 | 3/2011 | Kapusta et al. |
| 2011/0094373 | A1 | 4/2011 | Cassels |
| 2011/0173863 | A1 | 7/2011 | Ingram |
| 2011/0174148 | A1 | 7/2011 | Sy |
| 2011/0209377 | A1 | 9/2011 | Davies |
| 2011/0220088 | A1 | 9/2011 | Maggiore |
| 2011/0247254 | A1 | 10/2011 | Barnes |
| 2012/0000109 | A1 | 1/2012 | Zusman |
| 2012/0030983 | A1 | 2/2012 | Kuczynko et al. |
| 2012/0030987 | A1 | 2/2012 | Lee, III |
| 2012/0042557 | A1 | 2/2012 | Gomez et al. |
| 2012/0073177 | A1 | 3/2012 | Laney et al. |
| 2012/0079752 | A1 | 4/2012 | Peterson et al. |
| 2012/0111183 | A1 | 5/2012 | Hochstrate et al. |
| 2012/0132068 | A1 | 5/2012 | Kucynko |
| 2012/0137556 | A1 | 6/2012 | Laney et al. |
| 2012/0137562 | A1 | 6/2012 | Langevin et al. |
| 2012/0137869 | A1 | 6/2012 | Gomez et al. |
| 2012/0137872 | A1 | 6/2012 | Crommett |
| 2012/0152105 | A1 | 6/2012 | Gomez et al. |
| 2012/0167424 | A1 | 7/2012 | Gomez |
| 2012/0180353 | A1 | 7/2012 | Holmberg |
| 2012/0180354 | A1 | 7/2012 | Sullivan et al. |
| 2012/0186123 | A1 | 7/2012 | Troy et al. |
| 2012/0204713 | A1 | 8/2012 | Patel |
| 2012/0222344 | A1 | 9/2012 | Werner |
| 2012/0260793 | A1 | 10/2012 | Gomez |
| 2013/0055613 | A1 | 3/2013 | Gomez et al. |
| 2013/0068089 | A1 | 3/2013 | Brown |
| 2013/0097911 | A1 | 4/2013 | Larue |
| 2013/0152443 | A1 | 6/2013 | Gomez et al. |
| 2013/0174457 | A1 | 7/2013 | Gangl et al. |
| 2013/0192114 | A1 | 8/2013 | Christenson |
| 2013/0205637 | A1 | 8/2013 | Patel |
| 2013/0263732 | A1 | 10/2013 | Kucynko |
| 2013/0269232 | A1 | 10/2013 | Harris et al. |
| 2013/0269510 | A1 | 10/2013 | Sullivan |
| 2014/0026459 | A1 | 1/2014 | Yan et al. |
| 2014/0026744 | A1 | 1/2014 | Gomez et al. |
| 2014/0033590 | A1 | 2/2014 | Gomez |
| 2014/0041518 | A1 | 2/2014 | Neitzling |
| 2014/0060293 | A1 | 3/2014 | Gomez |
| 2014/0060509 | A1 | 3/2014 | Tseng |
| 2014/0068987 | A1 | 3/2014 | Burt |
| 2014/0075817 | A1 | 3/2014 | Gomez |
| 2014/0076144 | A1 | 3/2014 | Gomez |
| 2014/0076146 | A1 | 3/2014 | Gomez |
| 2014/0090283 | A1 | 4/2014 | Gomez |
| 2014/0163664 | A1 | 6/2014 | Goldsmith |
| 2014/0190056 | A1 | 7/2014 | Troy et al. |
| 2014/0230642 | A1 | 8/2014 | Reynolds et al. |
| 2014/0259843 | A1 | 9/2014 | Matteson |
| 2014/0260946 | A1 | 9/2014 | Gomez |
| 2014/0373415 | A1 | 12/2014 | Faifer |
| 2015/0027427 | A1 | 1/2015 | Maeda |
| 2015/0075052 | A1 | 3/2015 | Boyarkin |
| 2015/0260469 | A1 | 9/2015 | Gomez |
| 2015/0290775 | A1 | 10/2015 | Bennett et al. |
| 2015/0323269 | A1 | 11/2015 | McGinty |
| 2015/0330728 | A1 | 11/2015 | McGinty |
| 2015/0345895 | A1 | 12/2015 | Young |
| 2016/0047612 | A1 | 2/2016 | Sullivan et al. |
| 2016/0069636 | A1 | 3/2016 | Gomirato et al. |
| 2016/0116240 | A1 | 4/2016 | Gomez |
| 2016/0116249 | A1 | 4/2016 | Maugham |
| 2016/0305738 | A1 | 10/2016 | Huang et al. |
| 2016/0370135 | A1 | 12/2016 | Plumb et al. |
| 2017/0023328 | A1 | 1/2017 | Irvin et al. |
| 2017/0108303 | A1 | 4/2017 | Gomez |
| 2017/0115078 | A1 | 4/2017 | Plumb |
| 2017/0160027 | A1 | 6/2017 | Gangl |
| 2017/0205190 | A1 | 7/2017 | Jen et al. |
| 2017/0219311 | A1 | 8/2017 | Reavis, III |
| 2017/0241737 | A1 | 8/2017 | Keller, II |
| 2017/0321978 | A1 | 11/2017 | Brannan et al. |
| 2017/0328672 | A1 | 11/2017 | Hewes et al. |
| 2017/0368652 | A1 | 12/2017 | Chang et al. |
| 2018/0066906 | A1 | 3/2018 | Gomez |
| 2018/0119721 | A1 | 5/2018 | Gomez |
| 2018/0156568 | A1 | 6/2018 | Troy et al. |
| 2019/0017777 | A1 | 1/2019 | Wilson et al. |
| 2019/0063867 | A1 | 2/2019 | Gomez |
| 2019/0195581 | A1 | 6/2019 | Cassels |
| 2019/0293379 | A1 | 9/2019 | Taylor |
| 2020/0018564 | A1 | 1/2020 | Gomez |
| 2020/0096268 | A1 | 3/2020 | Lage |
| 2020/0240726 | A1 | 7/2020 | Spangler et al. |
| 2020/0370853 | A1 | 11/2020 | Jacobson et al. |
| 2021/0114174 | A1 | 4/2021 | Parra |
| 2023/0053496 | A1 | 2/2023 | Gomez |

OTHER PUBLICATIONS

U.S. Appl. No. 11/491,141, dated Jan. 23, 2008, Office Action in the U.S. Patent and Trademark Office.

U.S. Appl. No. 11/491,141, dated Aug. 13, 2008, Notice of Allowance in the U.S. Patent and Trademark Office.

U.S. Appl. No. 11/825,221, dated Feb. 5, 2010, Office Action in the U.S. Patent and Trademark Office.

U.S. Appl. No. 11/825,221, dated Jun. 18, 2010, Notice of Allowance in the U.S. Patent and Trademark Office.

U.S. Appl. No. 12/217,874, dated Jan. 4, 2011, Office Action in the U.S. Patent and Trademark Office.

U.S. Appl. No. 12/217,874, dated Oct. 12, 2011, Notice of Allowance in the U.S. Patent and Trademark Office.

U.S. Appl. No. 12/217,874, dated Oct. 12, 2011, Requirement for Restriction/Election in the U.S. Patent and Trademark Office.

U.S. Appl. No. 12/217,874, dated Nov. 15, 2011, Notice of Allowance in the U.S. Patent and Trademark Office.

U.S. Appl. No. 12/316,241, dated Feb. 7, 2011, Office Action in the U.S. Patent and Trademark Office.

U.S. Appl. No. 12/316,241, dated Oct. 12, 2011, Final Office Action In the U.S. Patent and Trademark Office.

U.S. Appl. No. 12/316,241, dated May 1, 2012, Office Action in the U.S. Patent and Trademark Office,.

U.S. Appl. No. 12/316,241, dated Sep. 27, 2012, Requirement for Restriction/Election in the U.S. Patent and Trademark Office.

U.S. Appl. No. 12/316,241, dated Oct. 12, 2012, Notice of Allowance in the U.S. Patent and Trademark Office.

U.S. Appl. No. 12/381,240, dated Feb. 15, 2011 Office Action in the U.S. Patent and Trademark Office.

U.S. Appl. No. 12/381,240, dated Sep. 14, 2011, Final Office Action In the U.S. Patent and Trademark Office.

U.S. Appl. No. 12/801,001, dated Feb. 15, 2012, Requirement for Restriction/Election in the U.S. Patent and Trademark Office.

(56) References Cited

OTHER PUBLICATIONS

U.S. Appl. No. 12/801,001, dated Nov. 19, 2012, Notice of Allowance in the U.S. Patent and Trademark Office.
U.S. Appl. No. 13/419,202, dated Aug. 30, 2012, Notice of Allowance in the U.S. Patent and Trademark Office.
U.S. Appl. No. 13/430,281, dated Dec. 5, 2012, Office Action in the U.S. Patent and Trademark Office.
U.S. Appl. No. 13/430,281, dated Apr. 17, 2013, Notice of Allowance in the U.S. Patent and Trademark Office.
U.S. Appl. No. 13/430,281, dated Nov. 5, 2013, Notice of Allowance in the U.S. Patent and Trademark Office.
U.S. Appl. No. 13/562,651, dated Jun. 10, 2014, Requirement for Restriction/Election in the U.S. Patent and Trademark Office.
U.S. Appl. No. 13/562,651, dated Aug. 26, 2014, Office Action in the U.S. Patent and Trademark Office.
U.S. Appl. No. 13/562,651, dated Jul. 9, 2015, Final Office Action in the U.S. Patent and Trademark Office.
U.S. Appl. No. 13/562,663, dated Sep. 25, 2014, Office Action in the U.S. Patent and Trademark Office.
U.S. Appl. No. 13/562,663, dated May 12, 2015, Notice of Allowance in the U.S. Patent and Trademark Office.
U.S. Appl. No. 13/588,294, dated Mar. 28, 2014, Requirement for Restriction/Election in the U.S. Patent and Trademark Office.
U.S. Appl. No. 13/588,294, dated Sep. 24, 2014, Notice of Allowance in the U.S. Patent and Trademark Office.
U.S. Appl. No. 13/738,894, dated May 7, 2014, Requirement for Restriction/Election In the U.S. Patent and Trademark Office.
U.S. Appl. No. 13/738,894, dated Dec. 3, 2014, Office Action in the U.S. Patent and Trademark Office.
U.S. Appl. No. 13/738,894, dated Dec. 15, 2015, Office Action in the U.S. Patent and Trademark Office.
U.S. Appl. No. 13/738,894, dated Aug. 3, 2016, Notice of Allowance in the U.S. Patent and Trademark Office.
U.S. Appl. No. 13/756,320, dated Jul. 12, 2013, Requirement for Restriction/Election in the U.S. Patent and Trademark Office.
U.S. Appl. No. 13/756,320, dated Sep. 11, 2013, Office Action in the U.S. Patent and Trademark Office.
U.S. Appl. No. 13/756,320, dated Jan. 27, 2014, Notice of Allowance in the U.S. Patent and Trademark Office.
U.S. Appl. No. 13/769,224, dated Aug. 9, 2013, Requirement for Restriction/Election in the U.S. Patent and Trademark Office.
U.S. Appl. No. 13/769,224, dated Nov. 29, 2013, Office Action in the U.S. Patent and Trademark Office.
U.S. Appl. No. 13/769,224, dated Mar. 18, 2014, Notice of Allowance in the U.S. Patent and Trademark Office.
U.S. Appl. No. 13/837,697, dated Jul. 16, 2014, Requirement for Restriction/Election in the U.S. Patent and Trademark Office.
U.S. Appl. No. 13/837,697, dated Sep. 30, 2014, Notice of Allowance in the U.S. Patent and Trademark Office.
U.S. Appl. No. 13/841,618, dated May 27, 2014, Notice of Allowance in the U.S. Patent and Trademark Office.
U.S. Appl. No. 14/470,513, dated Feb. 4, 2016, Requirement for Restriction/Election in the U.S. Patent and Trademark Office.
U.S. Appl. No. 14/470,513, dated Jun. 30, 2016, Office Action in the U.S. Patent and Trademark Office.
U.S. Appl. No. 14/575,923, dated Jul. 9, 2017, Notice of Allowance in the U.S. Patent and Trademark Office.
U.S. Appl. No. 14/575,923, dated Jan. 15, 2016, Office Action in the U.S. Patent and Trademark Office.
U.S. Appl. No. 14/575,923, dated May 6, 2016, Final Office Action in the U.S. Patent and Trademark Office.
U.S. Appl. No. 14/575,923, dated Jan. 12, 2017, Final Office Action in the U.S. Patent and Trademark Office.
U.S. Appl. No. 14/577,503, dated Jun. 10, 2015, Requirement for Restriction/Election in the U.S. Patent and Trademark Office.
U.S. Appl. No. 14/577,503, dated Aug. 28, 2015, Office Action in the U.S. Patent and Trademark Office.
U.S. Appl. No. 14/577,503, dated Nov. 12, 2015, Notice of Allowance in the U.S. Patent and Trademark Office.
U.S. Appl. No. 14/593,513, dated Aug. 13, 2015, Office Action in the U.S. Patent and Trademark Office.
U.S. Appl. No. 14/593,513, dated Jan. 14, 2016, Final Office Action in the U.S. Patent and Trademark Office.
U.S. Appl. No. 14/844,886, dated Feb. 29, 2016, Office Action in the U.S. Patent and Trademark Office.
U.S. Appl. No. 15/058,488, dated Dec. 9, 2016, Notice of Allowance in the U.S. Patent and Trademark Office.
U.S. Appl. No. 15/332,143, dated Nov. 15, 2017, Requirement for Restriction/Election In the U.S. Patent and Trademark Office.
U.S. Appl. No. 15/332,143, dated Aug. 27, 2018, Office Action in the U.S. Patent and Trademark Office.
U.S. Appl. No. 15/332,143, dated Jun. 13, 2019, Final Office Action in the U.S. Patent and Trademark Office.
U.S. Appl. No. 15/332,143, dated Feb. 21, 2020, Notice of Allowance in the U.S. Patent and Trademark Office.
U.S. Appl. No. 15/471,808, dated Nov. 1, 2017, Notice of Allowance in the U.S. Patent and Trademark Office.
U.S. Appl. No. 15/589,708, dated Jan. 10, 2018, Office Action in the U.S. Patent and Trademark Office,.
U.S. Appl. No. 15/589,708, dated Nov. 15, 2018, Notice of Allowance in the U.S. Patent and Trademark Office.
U.S. Appl. No. 15/596,834, dated May 17, 2018, Office Action in the U.S. Patent and Trademark Office.
U.S. Appl. No. 15/596,834, dated Jan. 23, 2019, Notice of Allowance in the U.S. Patent and Trademark Office.
U.S. Appl. No. 15/806,137, dated Nov. 1, 2018, Requirement for Restriction/Election in the U.S. Patent and Trademark Office.
U.S. Appl. No. 15/806,137, dated May 31, 2019, Office Action In the U.S. Patent and Trademark Office.
U.S. Appl. No. 15/806,137, dated Dec. 31, 2019, Notice of Allowance in the U.S. Patent and Trademark Office.
U.S. Appl. No. 15/811,404, dated Jan. 11, 2019, Requirement for Restriction/Election in the U.S. Patent and Trademark Office.
U.S. Appl. No. 15/811,404, dated Nov. 13, 2019, Office Action in the U.S. Patent and Trademark Office.
U.S. Appl. No. 15/811,404, dated Jun. 24, 2020, Notice of Allowance in the U.S. Patent and Trademark Office.
U.S. Appl. No. 15/918,935, dated Jan. 7, 2019, Requirement for Restriction/Election in the U.S. Patent and Trademark Office.
U.S. Appl. No. 15/918,935, dated Jul. 23, 2019, Office Action in the U.S. Patent and Trademark Office.
U.S. Appl. No. 15/918,935, dated Nov. 6, 2019, Notice of Allowance in the U.S. Patent and Trademark Office.
U.S. Appl. No. 16/277,506, dated Oct. 25, 2019, Office Action in the U.S. Patent and Trademark Office.
U.S. Appl. No. 16/277,506, dated Sep. 21, 2020, Notice of Allowance in the U.S. Patent and Trademark Office.
U.S. Appl. No. 16/430,865, dated Sep. 17, 2020, Office Action in the U.S. Patent and Trademark Office.
U.S. Appl. No. 16/430,865, dated Apr. 1, 2021, Notice of Allowance in the U.S. Patent and Trademark Office.
U.S. Appl. No. 16/916,026, dated Aug. 9, 201, Requirement for Restriction/Election in the U.S. Patent and Trademark Office.
U.S. Appl. No. 29/371,221, dated Mar. 15, 2011, Office Action in the U.S. Patent and Trademark Office.
U.S. Appl. No. 29/371,221, dated May 31, 2011, Notice of Allowance in the U.S. Patent and Trademark Office.
U.S. Appl. No. 29/439,542, dated Jan. 30, 2014, Ex Parte Quayle Action in the U.S. Patent and Trademark Office.
U.S. Appl. No. 29/439,542, dated Sep. 23, 2014, Final Office Action in the U.S. Patent and Trademark Office.
U.S. Appl. No. 29/439,542, dated Apr. 9, 2015, Notice of Allowance in the U.S. Patent and Trademark Office.
U.S. Appl. No. 29/449,534, dated Apr. 25, 2014, Notice of Allowance in the U.S. Patent and Trademark Office.
12" LWRC REPR SBR, [online], [2011]. Retrieved from the Internet: <URL: http://forum.lwrci.com/viewtopic.php?f=35&t=10081.
Brownells, Inc., "Brownells—Barrel Extension Torque Tool," YouTube video [online], published Oct. 6, 2011, [retrieved on Aug. 9, 2018]. Retrieved from the Internet: <URL: www.youtube.com/watch?v=n4Y_JrfDcXU>.

(56) References Cited

OTHER PUBLICATIONS

Charlie Cutshaw, "Fal Fever!" Combat Tactics, www.surefire.com; Fall 2005; 14 pages.
David Crane, "LMT MRP Piston/Op-Rod System v. HK416: 2,000-Round Head-to-Head Test," Defense Review (www.defensereview.com); Feb. 23, 2009 (5 web pages), plus 6 enlarged photographs from the web pages. [Reprint of text retrieved Nov. 12, 2015, online], Retrieved from the Internet: <URL: http://www.defensereview.com/lmt-mrp-pistonop-rod-system-vs-hk416-2000-round-head-to-head-test/>.
Iannamico, "The U.S. Ordnance Department Tests The German FG-42," Journal Article: The Small Arms Review, 2007: vol. 10(9), pp. 83-88.
International Search Report for PCT/US07/16133 mailed Nov. 6, 2008.
LWRC REPR 7.62mm Photo Gallery, [online], [retrieved on Nov. 5, 2009]. Retrieved from the Internet: <URL: http://www.xdtalk.com/forums/ar-talk/135060-lwrc-repr-7-62mm-photo-gallery.html.
Rob Curtis, "AAC's MPW "Honey Badger" don't care . . . ;" Military Times GearScout (http://blogs.militarytimes.com/gearscout/2011/10/15/aacs-mpw-h-oney-badger-dont-care/); Oct. 15, 2011 [Retrieved on May 17, 2013] (2 web pages), plus 4 enlarged photographs from the web pages.
Rob Curtis, Reaction Rod by Geissele Automatics, Military Times—Gear Scout, Oct. 12, 2012; , [online], [retrieved on Nov. 12, 2015]. Retrieved from the Internet: <URL: http://gearscout.militarytimes.com/2012/10/12/reaction-rod-by-geissele-automatics/>.
The Brownells Critical Tool Kit Website, "Brownells—AR-15/M16 Critical Tools Kit," [online], [retrieved on Aug. 10, 2018]. Retrieved from the Internet: <URL: http://investors.maxwell.com/phoenix.zhtml?c=94560&p=irol-newsArticle&ID=1903210 URL: <www.brownells.com/gunsmith-tools-supplies/general-gunsmith-tools/gunsmithing-tool-kits/ar-15-m16-critical-tools-kit-prod41214.aspx>.
U.S. Appl. No. 17/071,711, dated Oct. 5, 2022, Office Action in the U.S. Patent and Trademark Office.
U.S. Appl. No. 17/071,711, dated Apr. 12, 2023, Final Office Action in the U.S. Patent and Trademark Office.
U.S. Appl. No. 17/071,711, dated Oct. 4, 2023, Notice of Allowance in the U.S. Patent and Trademark Office.
U.S. Appl. No. 17/959,956, dated Oct. 2, 2023, Office Action in the U.S. Patent and Trademark Office.
U.S. Appl. No. 17/959,956, dated Jan. 24, 2024, Notice of Allowance in the U.S. Patent and Trademark Office.
U.S. Appl. No. 17/983,324, dated Jul. 26, 2023, Notice of Allowance in the U.S. Patent and Trademark Office.
U.S. Appl. No. 18/200,420, dated Dec. 28, 2023, Notice of Allowance in the U.S. Patent and Trademark Office.
U.S. Appl. No. 17/071,711, filed Oct. 15, 2020, U.S. Pat. No. 11,898,589, Feb. 13, 2024, Gomez.
U.S. Appl. No. 17/983,324, filed Nov. 18, 2022, U.S. Pat. No. 11,828,560, Nov. 28, 2023, Gomez.
U.S. Appl. No. 17/152,768, filed Jan. 19, 2021, U.S. Pat. No. 11,686,548, Jun. 27, 2023, Gomez.
U.S. Appl. No. 17/352,203, filed Jun. 18, 2021, U.S. Pat. No. 11,662,169, May 30, 2023, Gomez.
U.S. Appl. No. 16/916,026, filed Jun. 29, 2020, U.S. Pat. No. 11,530,892, Dec. 20, 2022, Gomez.
U.S. Appl. No. 16/784,058, filed Feb. 6, 2020, U.S. Pat. No. 11,493,292, Nov. 8, 2022, Gomez.
U.S. Appl. No. 16/782,855, filed Feb. 5, 2020, U.S. Pat. No. 11,460,265, Oct. 4, 2022, Gomez.
U.S. Appl. No. 16/430,865, filed Jun. 4, 2019, U.S. Pat. No. 11,067,352, Jul. 20, 2021, Gomez.
U.S. Appl. No. 16/277,506, filed Feb. 15, 2019, U.S. Pat. No. 10,895,430, Jan. 19, 2021, Gomez.
U.S. Appl. No. 15/811,404, filed Nov. 13, 2017, U.S. Pat. No. 10,808,748, Oct. 20, 2020, Gomez.
U.S. Appl. No. 15/332,143, filed Oct. 24, 2016, U.S. Pat. No. 10,697,726, Jun. 30, 2020, Gomez.
U.S. Appl. No. 15/806,137, filed Nov. 7, 2017, U.S. Pat. No. 10,598,452, Mar. 24, 2020, Gomez.
U.S. Appl. No. 15/918,935, filed Mar. 12, 2018, U.S. Pat. No. 10,591,245, Mar. 17, 2020, Gomez.
U.S. Appl. No. 15/596,834, filed May 16, 2017, U.S. Pat. No. 10,309,739, Jun. 4, 2019, Gomez.
U.S. Appl. No. 15/589,708, filed May 8, 2017, U.S. Pat. No. 10,240,883, Mar. 26, 2019, Gomez.
U.S. Appl. No. 15/471,808, filed Mar. 28, 2017, U.S. Pat. No. 9,915,497, Mar. 13, 2018, Gomez.
U.S. Appl. No. 13/526,651, filed Jul. 31, 2012, U.S. Pat. No. 9,816,546, Nov. 14, 2017, Gomez.
U.S. Appl. No. 14/575,923, filed Dec. 18, 2014, U.S. Pat. No. 9,810,495, Nov. 7, 2017, Gomez.
U.S. Appl. No. 14/844,886, filed Sep. 3, 2014, U.S. Pat. No. 9,772,150, Sep. 26, 2017, Gomez.
U.S. Appl. No. 14/475,513, filed Aug. 27, 2014, U.S. Pat. No. 9,658,011, May 23, 2017, Gomez.
U.S. Appl. No. 15/058,488, filed Mar. 2, 2016, U.S. Pat. No. 9,625,232, Apr. 18, 2017, Gomez.
U.S. Appl. No. 13/738,894, filed Jan. 10, 2013, U.S. Pat. No. 9,506,711, Nov. 29, 2016, Gomez.
U.S. Appl. No. 14/577,503, filed Dec. 19, 2014, U.S. Pat. No. 9,291,414, Mar. 22, 2016, Gomez.
U.S. Appl. No. 13/562,663, filed Jul. 31, 2012, U.S. Pat. No. 9,140,506, Sep. 22, 2015, Gomez.
U.S. Appl. No. 13/588,294, filed Aug. 17, 2012, U.S. Pat. No. 8,950,312, Feb. 10, 2015, Gomez.
U.S. Appl. No. 13/837,697, filed Mar. 15, 2013, U.S. Pat. No. 8,943,947, Feb. 3, 2015, Gomez.
U.S. Appl. No. 13/841,618, filed Mar. 15, 2013, U.S. Pat. No. 8,844,424, Sep. 30, 2014, Gomez.
U.S. Appl. No. 13/769,224, filed Feb. 15, 2013, U.S. Pat. No. 8,783,159, Jul. 22, 2014, Gomez et al.
U.S. Appl. No. 13/756,320, filed Jan. 31, 2013, U.S. Pat. No. 8,746,125, Jun. 10, 2014, Gomez et al.
U.S. Appl. No. 13/430,281, filed Mar. 26, 2012, U.S. Pat. No. 8,689,477, Apr. 8, 2014, Gomez et al.
U.S. Appl. No. 12/801,001, filed May 14, 2010, U.S. Pat. No. 8,387,513, Mar. 5, 2013, Gomez et al.
U.S. Appl. No. 12/316,241, filed Dec. 10, 2008, U.S Pat. No. 8,375,616, Feb. 19, 2013, Gomez et al.
U.S. Appl. No. 13/419,202, filed Mar. 13, 2012, U.S. Pat. No. 8,342,075, Jan. 1, 2013, Gomez.
U.S. Appl. No. 12/217,874, filed Jul. 9, 2008, U.S. Pat. No. 8,141,289, Mar. 27, 2012, Gomez et al.
U.S. Appl. No. 11/491,141, filed Jul. 24, 2006, U.S. Pat. No. 7,461,581, Dec. 9, 2008, Leitner-Wise.
U.S. Appl. No. 11/188,734, filed Jul. 26, 2005, U.S. Pat. No. 7,313,883, Jan. 1, 2008, Leitner-Wise.
U.S. Appl. No. 29/439,542, filed Dec. 12, 2012, U.S. Pat. No. D735,288, Jul. 28, 2015, Gomez.
U.S. Appl. No. 29/449,534, filed Mar. 15, 2013, U.S. Pat. No. D712,998, Sep. 9, 2014, Gomez.
U.S. Appl. No. 29/371,221, filed Dec. 2, 2010, U.S. Pat. No. D641,451, Jul. 12, 2011, Gomez et al.
U.S. Appl. No. 18/439,313, filed Feb. 12, 2024, 2024-0183380, Jun. 6, 2024, Gomez.
U.S. Appl. No. 18/520,676, filed Nov. 28, 2023, 2024-0093954, Mar. 21, 2024, Gomez.
U.S. Appl. No. 18/214,493, filed Jun. 26, 2023, 2023-0349658, Nov. 2, 2023, Gomez.
U.S. Appl. No. 18/200,420, filed May 22, 2023, 2023-0304760, Sep. 28, 2023, Gomez.
U.S. Appl. No. 17/988,740, filed Nov. 16, 2022, 2023-0106732, Apr. 6, 2023, Gomez.
U.S. Appl. No. 17/959,956, filed Oct. 4, 2022, 2023-0097029, Mar. 30, 2023, Gomez.
U.S. Appl. No. 12/381,240, filed Mar. 10, 2009, Gomez.
U.S. Appl. No. 61/524,500, filed Aug. 17, 2011, Gomez.
U.S. Appl. No. 17/959,956, dated Jun. 26, 2024, Notice of Allowance and Examiner's Interview Summary in the U.S. Patent and Trademark Office.

(56) References Cited

OTHER PUBLICATIONS

U.S. Appl. No. 17/988,740, dated Apr. 23, 2024, Ex parte Quayle Action in the U.S. Patent and Trademark Office.
U.S. Appl. No. 17/988,740, dated Jul. 22, 2024, Notice of Allowance in the U.S. Patent and Trademark Office.
U.S. Appl. No. 18/200,420, dated Apr. 30, 2024, Notice of Allowance in the U.S. Patent and Trademark Office.
U.S. Appl. No. 18/520,676, dated Jul. 5, 2024, Notice of Allowance in the U.S. Patent and Trademark Office.
U.S. Appl. No. 13/430,281, dated Aug. 14, 2013, Notice of Allowance in the U.S. Patent and Trademark Office.
U.S. Appl. No. 13/562,651, dated Sep. 21, 2016, Office Action in the U.S. Patent and Trademark Office.
U.S. Appl. No. 13/562,651, dated Jul. 7, 2017, Notice of Allowance in the U.S. Patent and Trademark Office.
U.S. Appl. No. 13/562,651, dated Jul. 31, 2017, Supplemental Notice of Allowance in the U.S. Patent and Trademark Office.
U.S. Appl. No. 14/470,513, dated Jan. 20, 2017, Notice of Allowance in the U.S. Patent and Trademark Office.
U.S. Appl. No. 14/575,923, dated Sep. 28, 2015, Requirement for Restriction/Election in the U.S. Patent and Trademark Office.
U.S. Appl. No. 14/593,513, dated Jul. 27, 2016, Notice of Allowance in the U.S. Patent and Trademark Office.
U.S. Appl. No. 14/593,513, dated Aug. 17, 2016, Corrected Notice of Allowance in the U.S. Patent and Trademark Office.
U.S. Appl. No. 14/844,886, dated Aug. 26, 2016, Final Office Action in the U.S. Patent and Trademark Office.
U.S. Appl. No. 14/844,886, dated Jan. 17, 2017, Notice of Allowance in the U.S. Patent and Trademark Office.
U.S. Appl. No. 14/844,886, dated May 19, 2017, Notice of Allowance in the U.S. Patent and Trademark Office.
U.S. Appl. No. 15/332,143, dated Apr. 29, 2020, Supplemental Notice of Allowance in the U.S. Patent and Trademark Office.
U.S. Appl. No. 16/277,506, dated Jun. 19, 2020, Final Office Action in the U.S. Patent and Trademark Office.
U.S. Appl. No. 16/782,855, dated Dec. 22, 2020, Requirement for Restriction/Election in the U.S. Patent and Trademark Office.
U.S. Appl. No. 16/782,855, dated May 3, 2021, Office Action in the U.S. Patent and Trademark Office.
U.S. Appl. No. 16/782,855, dated Feb. 18, 2022, Final Office Action in the U.S. Patent and Trademark Office.
U.S. Appl. No. 16/782,855, dated May 27, 2022, Notice of Allowance in the U.S. Patent and Trademark Office.
U.S. Appl. No. 16/916,026, dated Mar. 9, 2022, Office Action in the U.S. Patent and Trademark Office.
U.S. Appl. No. 16/916,026, dated Aug. 16, 2022, Notice of Allowance in the U.S. Patent and Trademark Office.
U.S. Appl. No. 17/959,956, dated Nov. 7, 2024, Notice of Allowance in the U.S. Patent and Trademark Office.
U.S. Appl. No. 17/983,324, dated Apr. 3, 2023, Notice of Allowance in the U.S. Patent and Trademark Office.
U.S. Appl. No. 18/200,420, dated Aug. 20, 2024, Notice of Allowance in the U.S. Patent and Trademark Office.
U.S. Appl. No. 18/520,676, dated Oct. 28, 2024, Notice of Allowance in the U.S. Patent and Trademark Office.

* cited by examiner

SECTION VIEW

FIREARM RECEIVER ASSEMBLY

RELATED APPLICATIONS

This application is a continuation of U.S. patent application Ser. No. 17/152,768, filed Jan. 19, 2021, which is a continuation of U.S. patent application Ser. No. 16/277,506, filed Feb. 15, 2019, granted as U.S. Pat. No. 10,895,430, which is a continuation of U.S. patent application Ser. No. 15/589,708, filed May 8, 2017, granted as U.S. Pat. No. 10,240,883, which is a continuation of U.S. patent application Ser. No. 14/844,886, filed Sep. 3, 2015, granted as U.S. Pat. No. 9,772,150, which is a continuation of U.S. patent application Ser. No. 13/562,663, filed Jul. 31, 2012, granted as U.S. Pat. No. 9,140,506, the contents of which is incorporated herein by reference in its entirety.

BACKGROUND OF THE INVENTION

Field of the Invention

The invention relates in general, to firearms and, more particularly, to firearms and, more particularly receivers which facilitate directly connecting both the barrel and the handguard directly to the receiver of the host firearm, each independent of the other.

Description of the Related Art

The use of autoloading rifles is prevalent with military, police and civilian shooters. Of the various autoloading rifle designs, few can compare with the popularity of the M16 family of firearms and its derivatives. The M16 family of firearms includes, but is not limited to, the AR15, M4, AR10, SR25 and piston operated designs such as LWRC International's M6 series of rifles. In general, the M16 family of firearms includes a lower receiver having a stock coupled to the rear end which is connected to an upper receiver having a barrel coupled to the front end. The chamber end of the barrel is received by a portion of the upper receiver and threadedly secured in place by a barrel nut.

Handguards are secured about the barrel to provide a surface by which the user may support the forward end of the firearm, protect the user's hand during use, and provide amounting platform for optics, lights, lasers and other devices which may become useful. Conventional handguards found on prior art M16 type rifles are not ideal for mounting secondary devices such as lights, lasers and optics. To more easily facilitate the mounting of such devices and for other advantages, handguards which incorporate a series of MIL-STD-1913 rails, or Picatinny rails, about their exterior were developed. An example of this type of handguard is the rail adaptor system (RAS) found in U.S. Pat. No. 5,826,363. The RAS consists of an aluminum tube that replaces the conventional handguard. The tube has a series of MIL-STD-1913 rails at the 3, 6, 9, 12 o'clock positions running along the longitudinal axis of the bore. MIL-STD-1913 rails allow for the easy installation and use of various accessories which enhance the functionality of the host firearm. The aluminum tube at the heart of the RAS is secured to the prior art barrel nut and at a point on the barrel itself. By contacting the barrel, the weight of accessories mounted to the handguards can affect the zero of the host firearm.

Subsequently, a variety of designs were developed. Some early designs rely on being supported by the legacy barrel nut of the M16 family of firearms. Other designs have been developed which rely on a proprietary barrel nuts that are used to secure the handguard and barrel to the receiver, effectively "free floating" the barrel. Free floating the barrel implies that the handguard is not in direct contact with the barrel of the associated firearm. By eliminating direct contact between the handguard and the barrel, the host firearms accuracy and precision are generally improved. Further, the zero established with the host firearm will not be affected by the mounting of optics, lasers, lights or other accessories to the handguard. However, the handguard used with these free floating designs can still flex. The flexing of the handguard occurs at the junction where the handguard is attached to the barrel nut which is in direct contact with the barrel. If sufficient weight or torque is applied to the handguard, such as through the use of a vertical grip, the zero of the weapon can be compromised. This flexing of a free floating handguard can also lead to premature wear of the host firearm's bolt.

Another design path which has been taken is manufacturing the upper receiver with an integral railed handguard. An example of these so called "monolithic" upper receivers is found in U.S. Publ. No. 2011/0005384, which includes a handguard that is integral with the receiver so that the handguard assists in retaining the barrel. This configuration, and those like it, have several disadvantages. Should the handguard become damaged in any way, the entire receiver with integral handguard must be replaced. This places a substantial financial burden upon the user. Further, the barrel is retained within the receiver extension of the receiver by securing the barrel to the handguard. Through the use of steel screws, the forward movement of the barrel is resisted. Unfortunately, the steel screws used to secure the barrel in place can potentially become over-torqued. Over-torqueing the screws can cause the heli-coil threads, or their equivalent, used for retaining the screws to bind up in the receiver, making future repair difficult and expensive. Alternatively, should the threaded inserts become damaged while the screws are being secured in place, such damage could prevent the barrel from being properly secured within the upper receiver thereby rendering the host firearm inoperable.

Therefore a need exists for a receiver assembly in which the barrel and the handguard are each directly secured to the upper receiver, independently of each other.

SUMMARY OF THE INVENTION

Accordingly, the present invention is directed to an upper receiver assembly for use with M16/AR15 type weapons. The upper receiver assembly includes an upper receiver, a handguard assembly, a piston assembly and a barrel assembly. A forward face of the upper receiver has a channel which receives the chamber end of the barrel assembly. Located above the channel is an opening which receives a portion of the host firearm's gas operating system. Located adjacent to the channel is a placement for receiving and supporting the spring cup of the piston assembly and prevents the spring cup from rotating during normal operation of the host firearm.

Located about the forward end of the upper receiver assembly is a receiver extension which is generally shaped like an elongated cylinder with an upper portion removed. When viewed straight on from the front, the receiver extension looks like a "C" rotated on its side. The interior of the receiver extension is threaded to receive the lock nut which is part of the barrel assembly. The lock nut is generally circular in shape with an opening through its interior machined to receive a portion of the barrel therein. Once the barrel is inserted into the channel located at the forward end of the upper receiver, the lock nut is threadedly received by the receiver extension where it secures the barrel directly to the receiver.

The handguard assembly includes a top segment and a bottom segment separable from one another. The rear end of the bottom segment has a generally cylindrical opening and a bore that receives the receiver extension. Fasteners are used to secure the bottom segment of the handguard assembly directly to the receiver extension of the upper receiver.

In view of the foregoing, one object of the present invention is to provide an upper receiver assembly for use with an automatic firearm of the M16/AR15 type that has an upper receiver with a receiver extension, a handguard assembly, a piston assembly and a barrel assembly, the upper receiver being configured to mount each of the barrel assembly and the handguard assembly directly to the receiver extension, independently of each other.

Another object of the present invention is to provide an upper receiver assembly in accordance with the preceding object in which the barrel assembly has an integral barrel nut that is threaded for coupling with a lock ring to secure the barrel directly to the receiver extension of the upper receiver.

Yet another object of the present invention is to provide an upper receiver assembly in accordance with the preceding objects in which the receiver extension provides a mounting member that is integral with the upper receiver to which a removable handguard may be secured.

A further object of the present invention is to provide an upper receiver assembly in accordance with the preceding objects in which the upper receiver free floats the host firearm's barrel assembly without using a conventional barrel nut as a mounting point for the handguard.

A still further object of the present invention is to provide an upper receiver assembly in accordance with the preceding objects in which the upper receiver provides a mounting point for a portion of the gas operating system of the firearm.

Yet a still further object of the present invention is to provide an upper receiver in accordance with the preceding objects in which the upper receiver assembly includes a placement to receive and support the gas piston assembly of the firearm.

Another object of the present invention is to provide a locknut having a grippable structure configured to engage with a specialized wrench used to apply torque to the locknut when securing the barrel to the upper receiver.

Still another object of the present invention is to provide a locknut and wrench in accordance with the preceding object in which the grippable structure of the locknut includes a plurality of cutouts spaced around a forward face of the locknut, and the wrench includes a gripping structure embodied as a plurality of teeth which project outwardly from a forward edge of the wrench to engage with the cutouts on the locknut.

It is yet another an object of the invention to provide an upper receiver assembly in accordance with the preceding objects that is not complex in structure but yet provides for direct mounting of the barrel and the handguard assembly to the receiver extension of the upper receiver assembly, each independently of one another.

These together with other objects and advantages which will become subsequently apparent reside in the details of construction and operation as more fully hereinafter described and claimed, reference being made to the accompanying drawings forming a part hereof, wherein like numerals refer to like parts throughout.

DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended to define the limits of the invention.

DETAILED DESCRIPTION OF THE PREFERRED EMBODIMENTS

The present invention is directed towards an upper receiver assembly for use with the M16 family of firearms to include the AR15, M4, AR10, SR25 and piston operated designs such as LWRC International's M6 series of rifles. Unless otherwise specified, the various components which make up the trigger mechanism, lower receiver assembly, buttstock assembly, bolt and bolt carrier assembly are those found on the prior art M4 and M16 family of firearms.

More particularly, the present invention is an upper receiver assembly constructed to provide a mounting point for a barrel and a handguard mounting member for a handguard assembly. The barrel mounting point and handguard mounting member are integral to the receiver assembly. The novel receiver assembly facilitates the mounting of a barrel and handguard independently of each other.

As used herein, the word "front" or "forward" corresponds to the barrel end (i.e., to the right as shown in FIGS. 1, 14-15 and 17-19), and "rear" or "rearward" or "back" corresponds to the direction opposite the barrel end, where the firearm buttstock is located (i.e., to the left as shown in FIGS. 1, 14-15 and 17-19).

Figure 1:
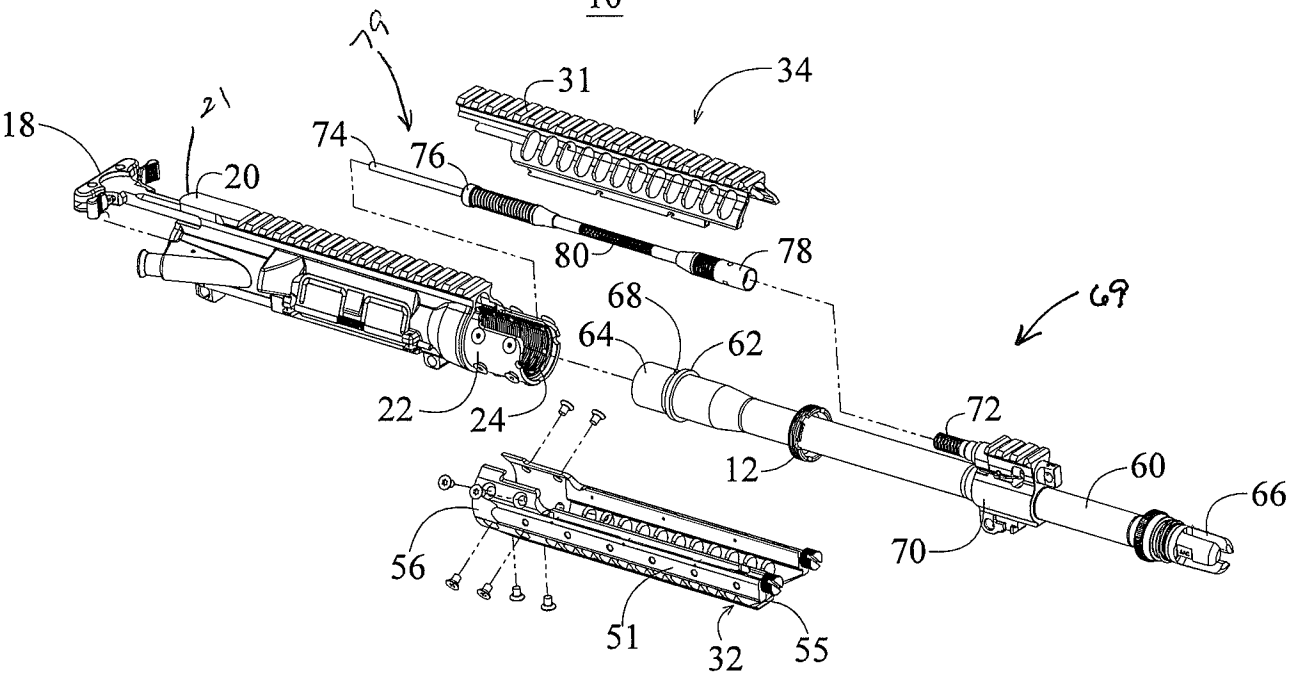
FIG. 1 is an exploded perspective view of an upper receiver assembly including an upper receiver, a handguard assembly, a piston assembly and a barrel assembly, in accordance with the present invention.
Figure 10:
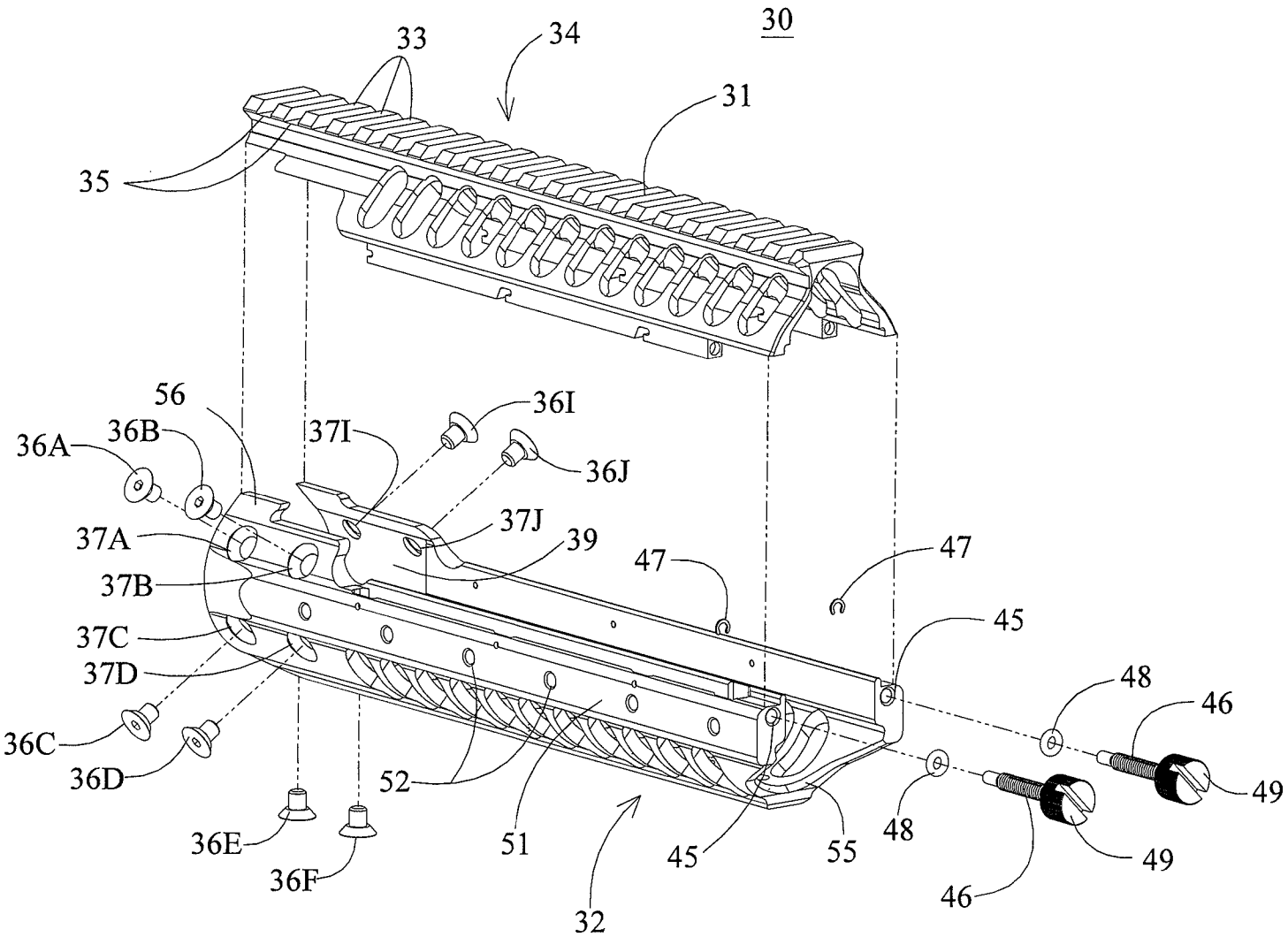
FIG. 10 is an exploded right side perspective view of the handguard assembly as shown in FIG. 1.
Figure 11:
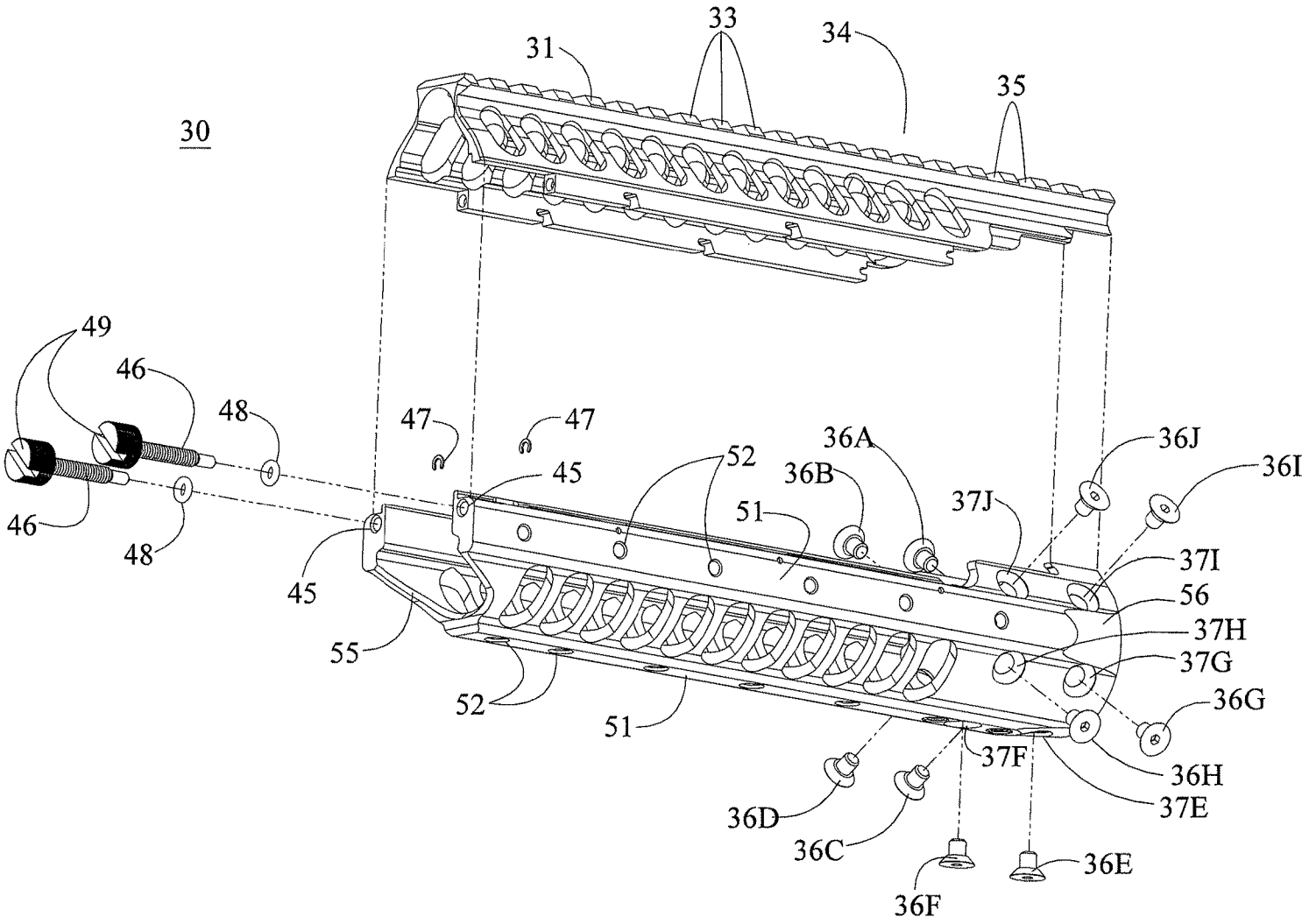
FIG. 11 is a left side perspective view of the handguard assembly shown in FIG. 10.
Figure 12:
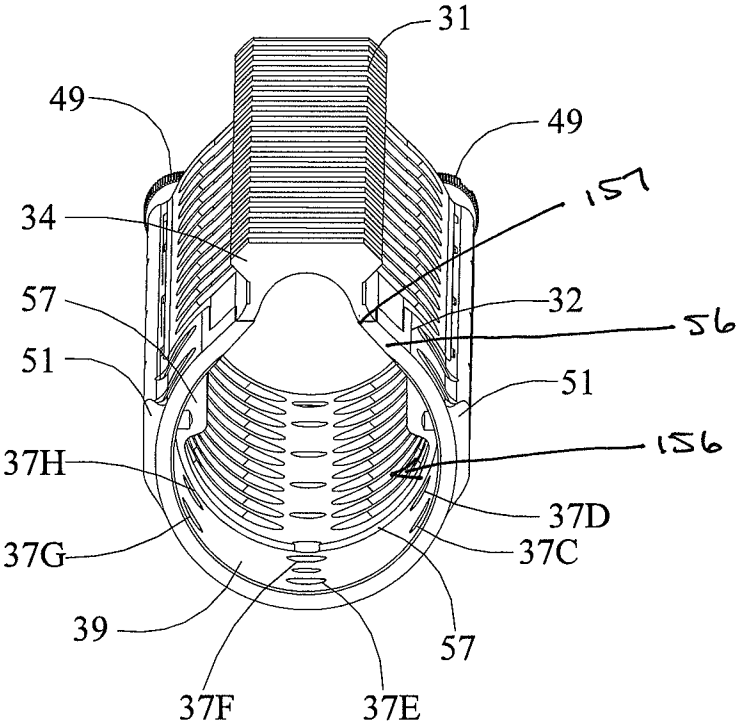
FIG. 12 is a rear perspective view of the handguard assembly shown in FIG. 10.
Figure 13:
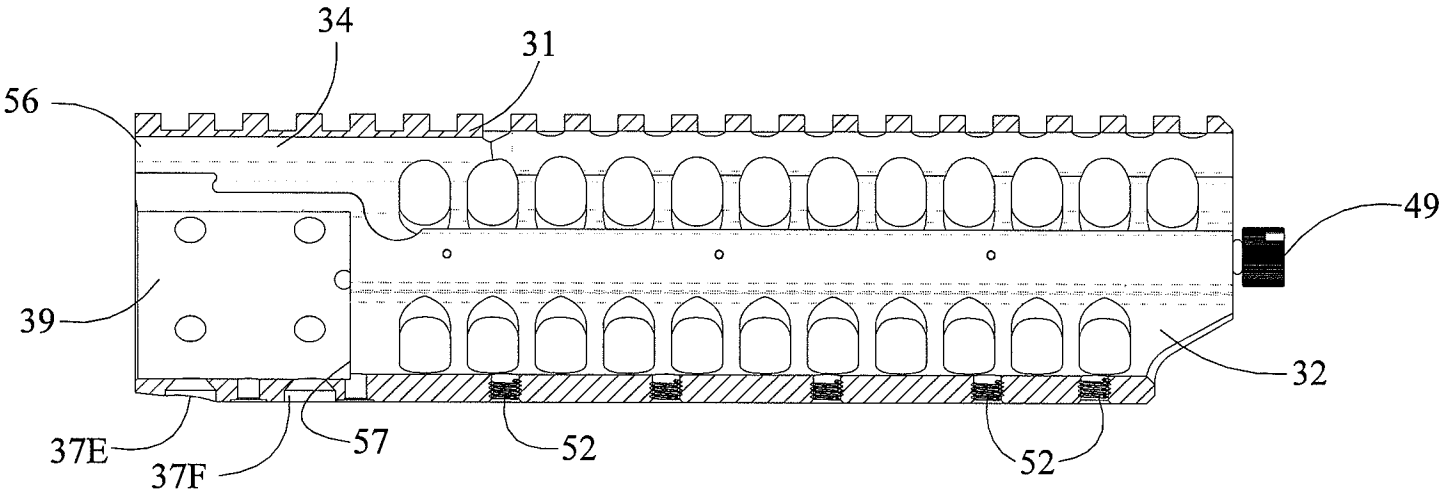
FIG. 13 is a side cutaway view of the handguard assembly shown in FIG. 10.

FIG. 1 is an exploded perspective view of a firearm upper receiver assembly 10 including an upper receiver 20, a handguard assembly generally designated by reference numeral 30 (see FIG. 10), a piston assembly generally designated by reference numeral 79 and a barrel assembly generally designated by reference numeral 69. The upper receiver 20 has a receiver extension 22 with a threaded opening 24. The threaded opening 24 of the extension member 22 is configured to threadedly receive a lock nut 12 which is used to secure the barrel to the upper receiver. The barrel assembly 69 includes a barrel 60 and is shown with a flash hider 66 threadedly secured about the end of the muzzle. The construction of the barrel 60 is of a conventional M16 type.

The rearward or chamber end 64 of the barrel 60 has an annular flange 62. An indexing pin 68 is located on the top surface of the barrel 60, between the annular flange 62 and the rearward end 64 of the barrel 60. Located near the front or muzzle end of the barrel 60 is a gas block 70 which has a gas nozzle 72 incorporated therein.

The piston assembly 79 as shown includes a piston cup 78, a connecting rod 80, a spring cup 76 and an operating rod 74. The piston assembly 79, gas nozzle 72 and gas block 70 are components of the operating system being used with the illustrated embodiment. The specific components and features which make up the piston assembly 79, gas nozzle 72 and gas block 70, along with the methods of their installation, are described in commonly owned U.S. Pat. No. 7,461,581 ("the '581 patent") which is expressly incorporated by reference as if fully set forth herein in its entirety. Any manner in which the piston assembly 79, gas nozzle 72, and gas block 70 differ from the '581 patent will be disclosed herein.

Also shown in FIG. 1 is a charging handle 18 for use in the operation of the firearm when the upper receiver assembly 10 is fully assembled. The charging handle 18 used with the upper receiver 20 can be any type which will work with prior art M16/AR15 type firearms.

The handguard assembly 30 includes a bottom segment 32 and a top segment 34. A plurality of fasteners 36 (generally ten fasteners 36A-36J) (see FIG. 10) are provided to secure the bottom segment 32 of the handguard assembly 30 to the receiver extension 22. The method of securing the top segment 34 of the handguard assembly 30 to the bottom segment 32 and the specific components used are described in commonly owned U.S. Pat. No. 8,141,289 ("the '289 patent") which is expressly incorporated by reference as if fully set forth herein in its entirety. The specific ways in which the handguard assembly 30 differs from that disclosed in the '289 patent will be disclosed herein.

Figure 2:
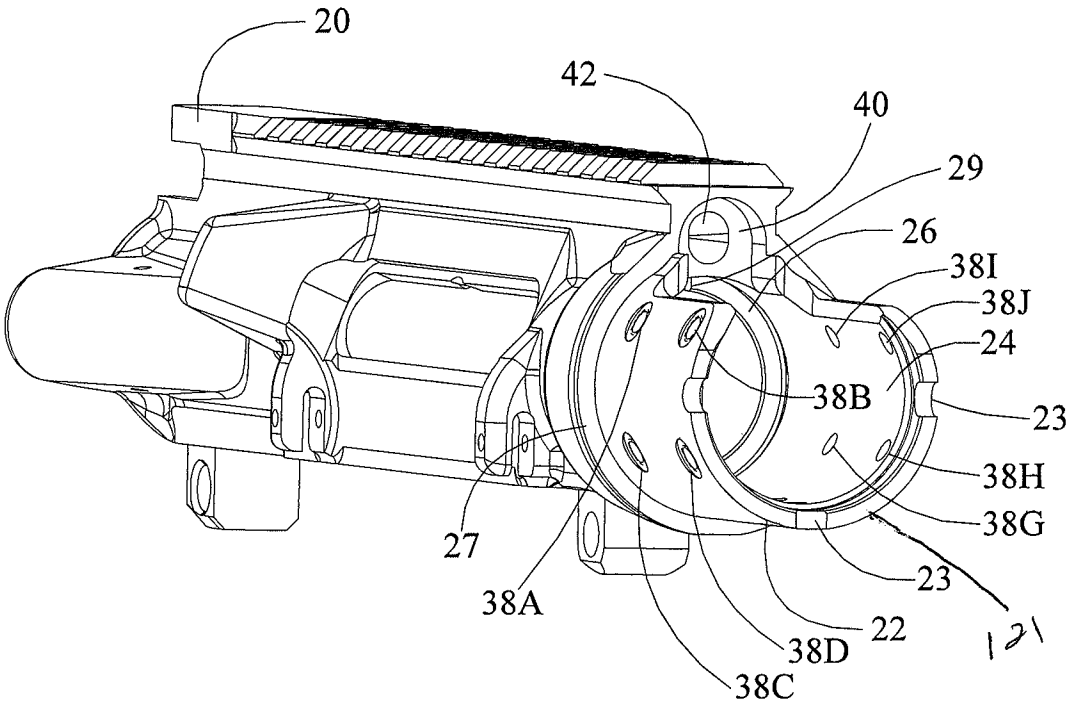
FIG. 2 is an isolated perspective view of the right side of the upper receiver as shown in FIG. 1.
Figure 3:
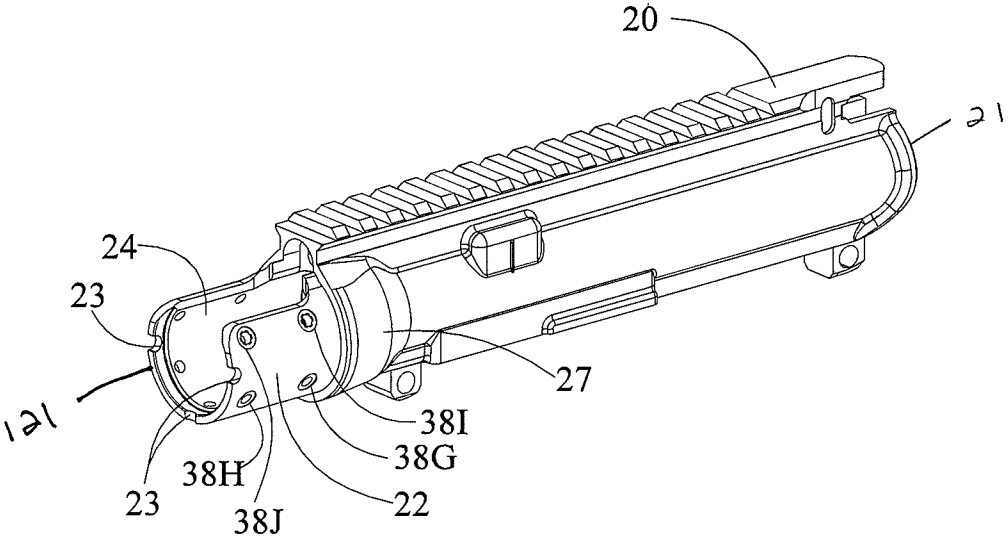
FIG. 3 is an isolated perspective view of the left side of the upper receiver shown in FIG. 2.
Figure 4:
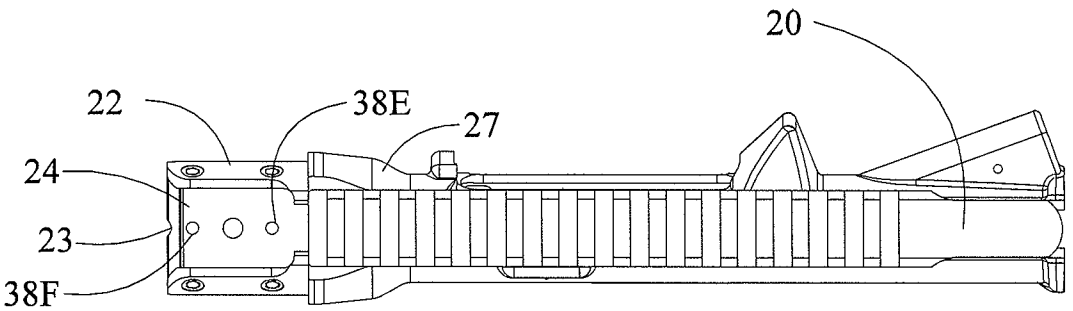
FIG. 4 is a top view of the upper receiver shown in FIGS. 2 and 3.
Figure 5:
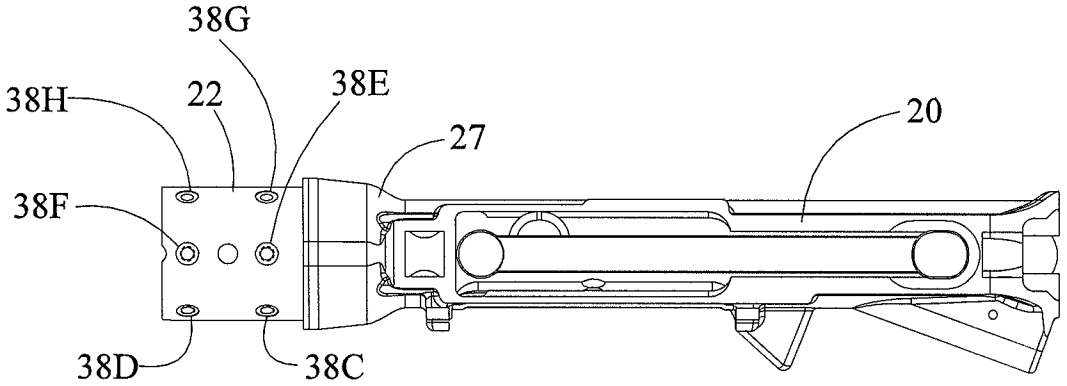
FIG. 5 is a bottom view of the upper receiver shown in FIGS. 2 and 3.

Referring now to FIGS. 2-7, several views of the upper receiver 20 are shown. The upper receiver 20 has an integral receiver extension 22. The receiver extension 22 is an elongated cylinder with a top portion removed, resulting in an approximately semi-circular opening 24, as best shown in FIG. 2. This semi-circular opening 24 is threaded about its interior and has an inside diameter sized to receive the annular flange 62 of the barrel 60. A series of threaded openings 38A-38J are located about the exterior of the receiver extension 22. Located at the forward end of the receiver extension 22 are three "U" shaped relief cuts 23. The relief cuts 23 are generally located at the 3, 6 and 9 o'clock positions about the forward face 121 of the receiver extension 22. The relief cuts 23 accommodate a portion of the screw 58 used to secure optional rail segments 50 (see FIG. 14) to the mounting surfaces 51 of the bottom segment 32 of the handguard assembly 30 (shown in FIGS. 14-17).

Figure 7:
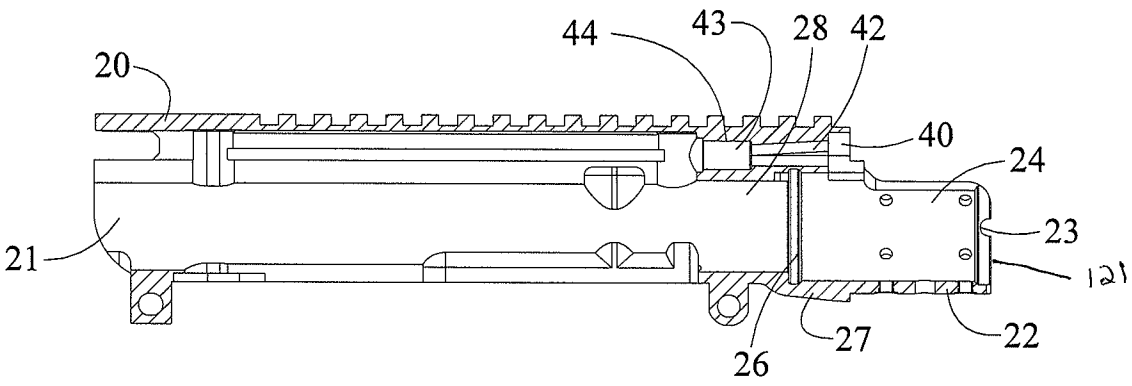
FIG. 7 is a side cutaway view of the upper receiver shown in FIG. 6, taken along line A-A.
Figure 6:
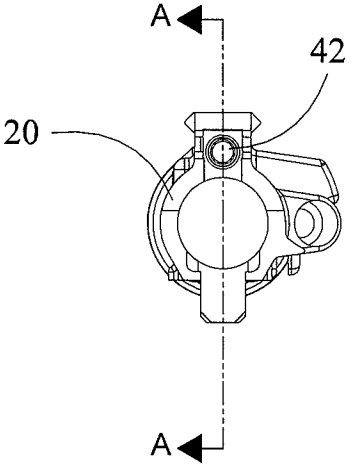
FIG. 6 is a rear view of the upper receiver shown in FIGS. 2 and 3.

Located at the back end of the interior area of the receiver extension 22 is an annular bearing surface 26 (see FIG. 7). The bearing surface 26 generally defines the opening into the longitudinally extending, chamber receiving channel 28 of the upper receiver 20. The bearing surface 26 is only broken about its top surface by a notch 29 (see FIG. 2) which receives the indexing pin 68 on the chamber end 64 of the barrel to prevent rotational movement of the barrel 60.

Located above the receiver extension 22 is a placement 40 for the spring cup 76 of the gas piston assembly. The placement is generally "U" shaped and constructed to receive and resist the rotation of the spring cup 76. The placement 40 also includes a bore 42 which is sized to receive a portion of the operating rod 74 used with the gas piston assembly. The bore 42 has a generally oval shape when viewed from the front. The bore 42 is largest at its front end and gradually tapers down in size towards its rearward end. The bottom interior wall of the bore 42 is parallel to the bore line of the barrel 60, while the gradual taper of the bore 42 (best shown in FIG. 7) is the result of its top interior wall being machined at an angle. The angle of the top interior wall of the bore 42 is selected to facilitate the installation of the piston assembly 79. Located behind and in line with the bore 42 is a placement 44 for a bushing 43. The bushing 43 is a metal cylinder with an opening therethrough which is sized to allow the passage of the operating rod 74 into the upper receiver 20 during the normal operation of the host firearm. The bushing 43 also prevents direct contact between the operating rod 74 and the upper receiver 20. Finally, the bushing 43 directs the operating rod 74 so that it makes contact with the strike face of the host firearm's bolt carrier group (not shown).

Adjacent to the receiver 22 extension is a transition portion 27 (see FIG. 14) of the upper receiver assembly 10. The transition portion 27 has a generally conical shape which tapers down in diameter towards its rearward end. The forward diameter of the transition portion 27 is greater than the exterior diameter of the receiver extension 22 and is an integral portion of the upper receiver's 20 forward end.

Figure 8:
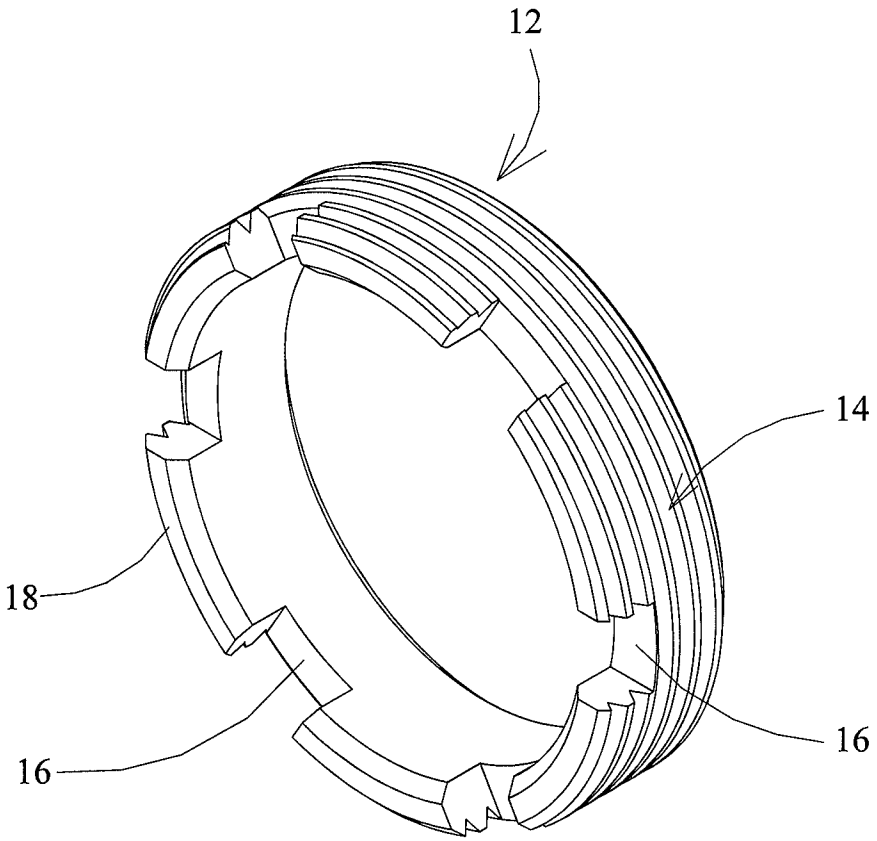
FIG. 8 is a front perspective view of the lock nut of the upper receiver assembly shown in FIG. 1.

FIG. 8 shows a front end perspective view of the locknut 12 used to secure the barrel 60 to the upper receiver 20. The locknut 12 has threads 14 about its exterior that are configured to enable the locknut 12 to be threadedly received into the threaded opening 24 of the receiver extension 22 during assembly. The locknut 12 includes a grippable structure preferably embodied as a plurality of cutouts or grooves 16 spaced evenly about the front face 18 of the locknut 12.

Figure 9B:
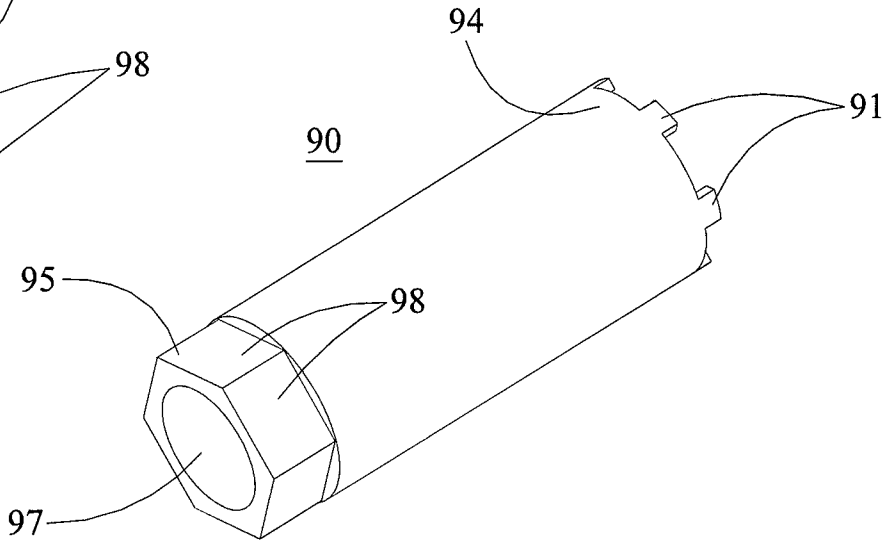
FIG. 9B is a perspective view of the wrench shown in FIG. 9A rotated 180 degrees.
Figure 9A:
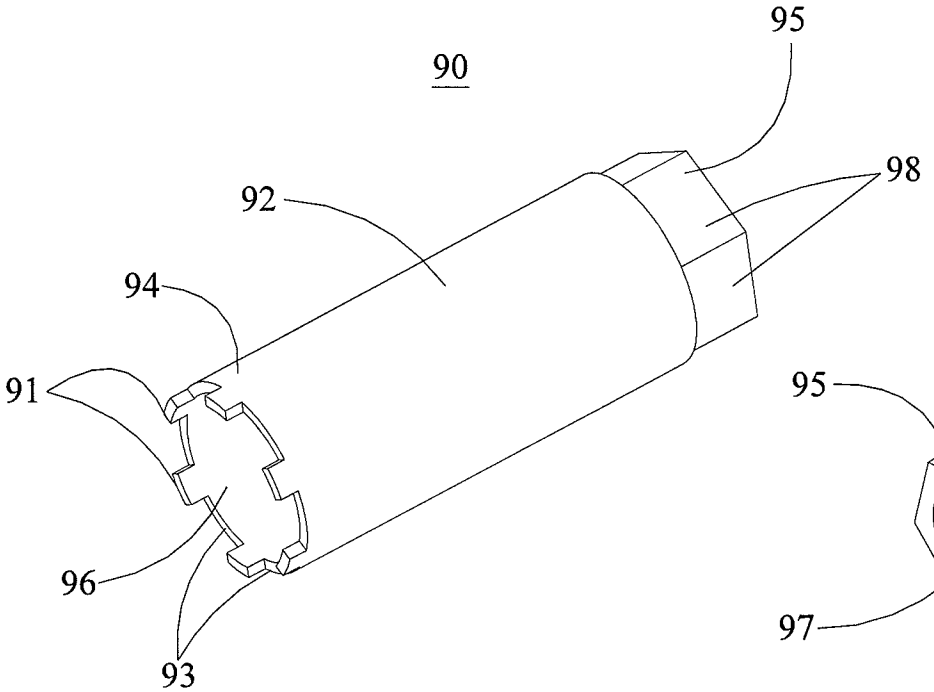
FIG. 9A is a perspective view of a specialized wrench used to secure the locknut shown in FIG. 8 against the annular flange of the barrel when securing the barrel to the receiver assembly, as shown in FIG. 1.
Figure 9C:
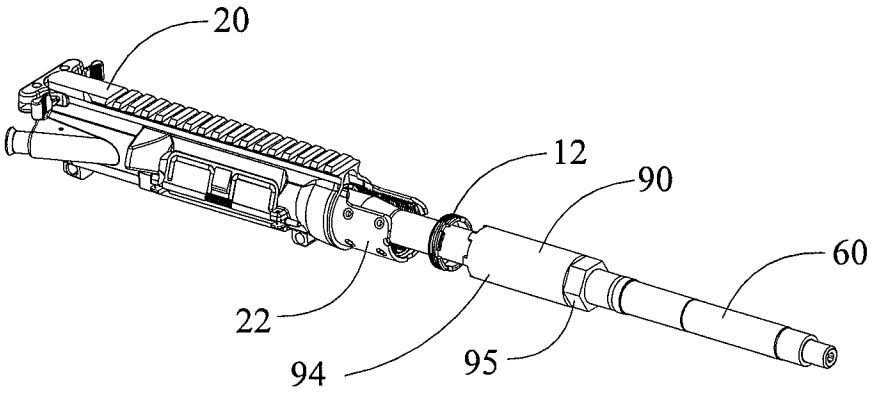
FIG. 9C is a perspective view of the upper receiver having a barrel attached thereto in accordance with the present invention.

FIGS. 9A through 9C show a specially designed wrench, generally designated by reference numeral 90, used to secure the lock nut 12 to the upper receiver 20. The wrench 90 has a cylindrical body 92 with a cylindrically shaped head, generally designated by reference numeral 94, defining a circular opening 96 having an exterior periphery. The exterior periphery includes a gripping structure embodied as a plurality of teeth 91 which project outwardly from the forward edge 93 of the cylindrical head 94. The teeth 91 are generally perpendicular to the forward edge 93 of cylindrical head 94 of the wrench 90 and are configured to engage with the cutouts or grooves 16 on the front face 18 of the lock nut 12. The body 92 has an aperture 97 therein which is configured to receive and allow the passage of the barrel 60 (shown in FIG. 9C). The proximal end 95 of the wrench 90 opposite the head 94 is shaped like a hexagon, including a series of flats 98. The flats 98 are designed to be received by virtually any type of conventional crescent wrench or similarly styled wrench found throughout the prior art. It is to be expressly understood that the flats 98 defined by the proximal end 95 of the wrench 90 can be constructed to interface with either metric or English standard wrenches.

The handguard assembly 30 is shown in FIGS. 10-13 and includes a top segment 34 and a bottom segment 32. The top segment 34 secures to the bottom segment 32 in substantially the same way as described in the '289 patent. The top segment 34 includes an integral attachment surface, generally referred to as the rail portion 31, located along its upper surface. The rail portion 31 includes a number of rails 33 extending therealong separated by traverse grooves 35 therebetween. In the illustrated embodiment, the rail portion 31 of the handguard's top segment 34 is manufactured in accordance with the MIL-STD-1913 rail specification.

The bottom segment 32 of the handguard has a front portion 55 and a rear portion 56. The front portion 55 of the bottom segment 32 is angled to reduce weight and improve the visual appeal of the handguard assembly 30 as a whole. Located at the front portion 55 are two receptacles 45 for two pusher screws 46 that rely on c-clips 47 and o-rings 48 as a means to retain the screws 46. The head 49 of each pusher screw 46 is textured and of sufficient size to be gripped and rotated by the end user.

The rear portion 56 of the bottom segment 32 has an opening generally designated by numeral 156 into the interior of the bottom segment 32. The opening 32 is generally circular in shape with the apex 157 of the opening having been removed. Located adjacent to the opening 156 is a bore 39 which defines a portion of the bottom segment's 32 interior. The bore 39 is defined at its rearward end by the opening 156 located at the rearward end of the bottom segment 32. The forward end of the bore 39 is defined by an approximately semi-circular bearing surface 57 (see FIG. 12). The bore 39 has a smooth interior and is constructed to receive the receiver extension 22.

Located about the rear portion 56 of the bottom segment 32 are ten openings 37A-37J which extend from the exterior into the interior. These openings 37A-37J are placed to align with the threaded openings 38A-38J present about the exterior of the receiver extension 22 (see FIGS. 1-5 and 7). The openings 37A-37J are counter sunk and shaped to receive the head of the fasteners 36A-36J used to secure the bottom segment 32 to the receiver extension 22. The apex 157 of the opening 156 present on the top side of the bottom segment's 32 rear portion 56 is machined to receive a portion of the top segment 34 such that the two parts look to be one as assembled. Located at the 3, 6 and 9 o'clock positions about the exterior of the bottom segment 32 are a series of mounting surfaces 51. The mounting surfaces 51 run longitudinally the approximate length of the bottom segment 32 and are generally rectangular in shape, having a plurality of threaded openings 52 along their length.

To assemble the receiver assembly 10 as shown in FIGS. 14-20, the following steps must be taken. The upper receiver 20 is secured to a fixture (not shown) and held in a vice (not shown) to prevent unintentional rotation or movement. There are many suitable prior art fixtures which are capable of performing this task.

Initially, the bushing 43 is pressed into the placement 44 found on the interior of the upper receiver 20 (see FIG. 7). The chamber end 64 of the barrel 60 is inserted into the threaded opening 24 of the receiver extension 22. The barrel 60 is oriented during insertion so that the indexing pin 68 is received by the notch 29 located on the upper receiver 20, and the annular flange 62 comes to rest against the annular bearing surface 26 (see FIG. 7) found on the upper receiver 20. As noted previously herein, positioning of the indexing pin 68 within the notch 29 assists in preventing rotational movement of the barrel 60. A locknut 12 is then slid down the barrel so that the threads 14 of the locknut 12 may engage with the threaded opening 24 of the receiver extension 22. The wrench 90 is then slid over the barrel and used to secure the lock nut 12 in place with the appropriate pre-determined torque value (see FIG. 9C). The aperture 97 of the wrench 90 is of sufficient size to fit about the barrel 60, and the teeth 91 around the periphery of the opening 96 are constructed to interface with the cutouts 16 on the forward face of the lock nut 12. A secondary crescent style wrench is then used to apply a predetermined torque value to the locknut 12, thus securing the locknut 12 and thereby the barrel 60 to the upper receiver 20.

The gas block 70, gas nozzle 72 and flash hider 66 are installed onto the barrel 60, in a manner that is well known in the prior art. The piston assembly 79 is assembled in essentially the same manner as described in the '581 patent. Initially, the piston cup 78 is independently placed on the gas nozzle 72. The rear end of the operating rod 74 is then inserted into the bore 42 located above the chamber receiving channel 28 of the upper receiver 20 by grasping the forward end of the operating rod 74 and thereby compressing the spring of the piston assembly so that the operating rod 74 may then be rotated into a position which places it in line with the rearward face of the piston spring cup 78. While rotating the operating rod 74 into position, the spring cup 76 is received by the placement 40 machined on the forward face of the upper receiver 20. The spring cup 76 has been machined to be securely received and supported by the placement 40. Holding the operating rod 74 in its compressed position, the connecting rod 80 is then inserted into the opening (not shown) present on the forward end of the operating rod 74. This assembly is then aligned with the opening (not shown) present on the back side of the piston cup 78 and released so that a forward portion of the connecting rod 80 is received by the opening on the back side of the piston cup 78, thereby holding the operating rod 74, connecting rod 80, and piston cup 78 in operational alignment.

Next, the rearward end of the handguard's bottom segment 32 is slid over a portion of the receiver extension 22. The receiver extension 22 is received within the bore 39 located within the rear portion 56 of the bottom segment 32. The forward edge of the receiver extension 22 comes to rest against the bearing surface 57 present at the forward end of the handguard's interior bore 39. Fasteners 36A-36J are inserted through openings 37A-37J located about the exterior of the bottom segment 32 and threadedly received by the threaded openings 38A-38J located about the receiver extension 22. The fasteners 36A-36J, when threadedly secured in place, prevent the rotational and longitudinal movement of the handguard assembly 30. The top segment 34 is then installed on the bottom segment 32 in substantially the same way as described in the '289 patent.

Figure 14:
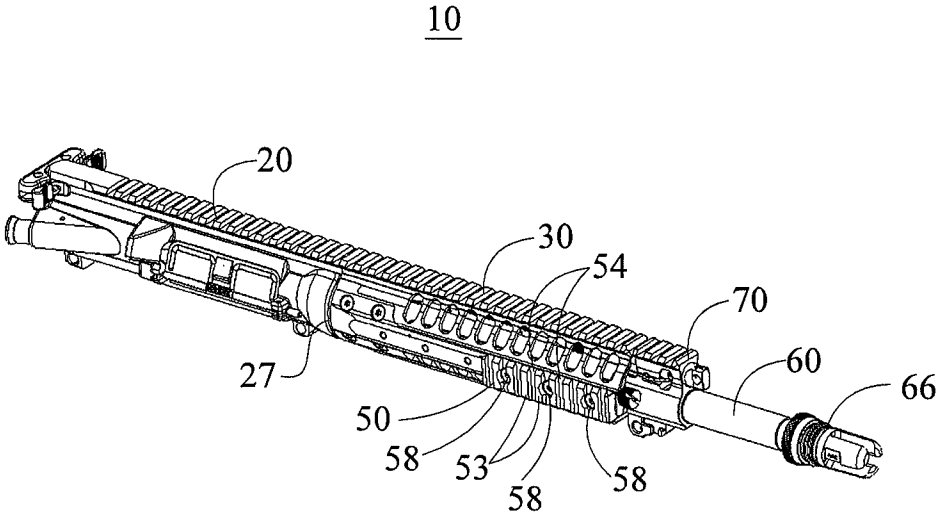
FIG. 14 is a perspective right side view of the upper receiver assembly shown in FIG. 1, as assembled.
Figure 15:
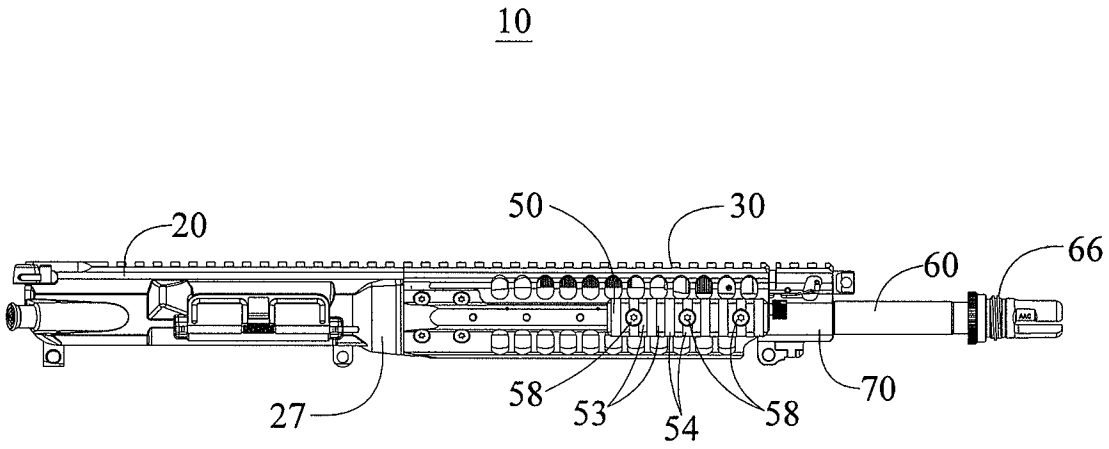
FIG. 15 is a right side view of the assembled receiver assembly shown in FIG. 14.
Figure 16:
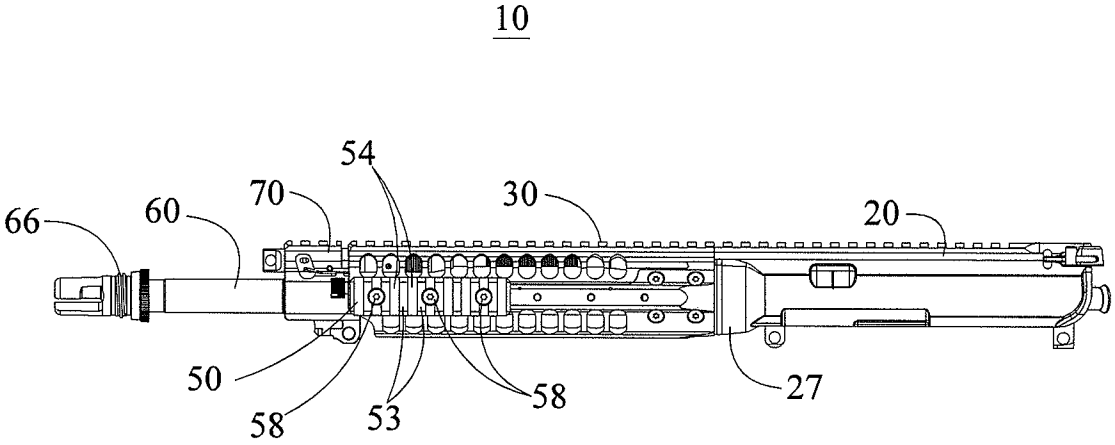
FIG. 16 is a left side view of the assembled receiver assembly shown in FIG. 14.
Figure 17:
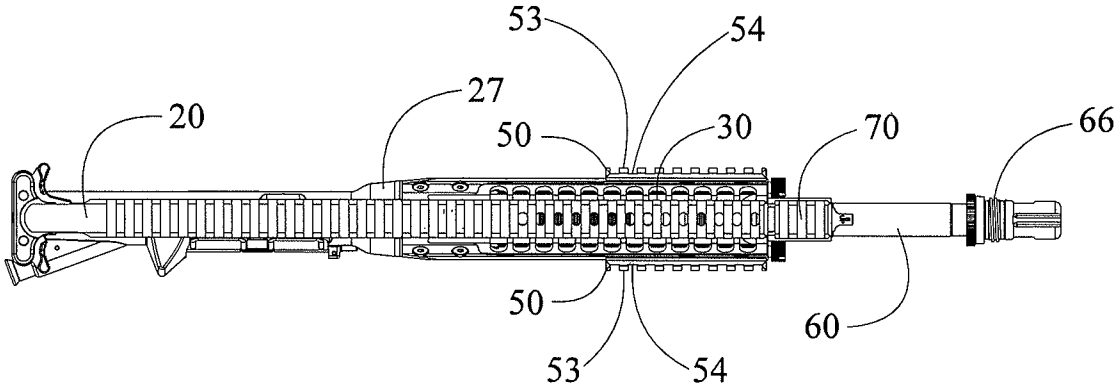
FIG. 17 is a top view of the assembled receiver assembly shown in FIG. 14.

As shown in FIG. 14, rail segments 50, also known as accessory mounting points, of various lengths may be included. The rail segments 50 are manufactured in accordance with the MIL-STD-1913 rail specifications. Each rail segment 50 includes a plurality of rails 53 separated by traverse grooves 54 located therebetween. The number of rails 53, and thus the longitudinal length of the rail segments 50, varies based on the accessories being mounted to the handguard 30. The rail segments 50 are secured to the mounting surfaces 51 of the bottom segment 32 of the handguard 30 through the use of screws 58 (shown in FIGS. 14 through 17). The screws 58 are received through bore(s) present in the rail segments 50 and threadedly received by the threaded openings 52 present on the mounting surfaces 51, thereby securing the rail segments 50 to the mounting surfaces 51. Rail segments 50 with a varying number of rails 53 may be constructed based on the end user's needs. However, the installation of the rail segments 50 onto the bottom segment 32 of the handguard assembly 30 is optional and not required.

Figure 18:
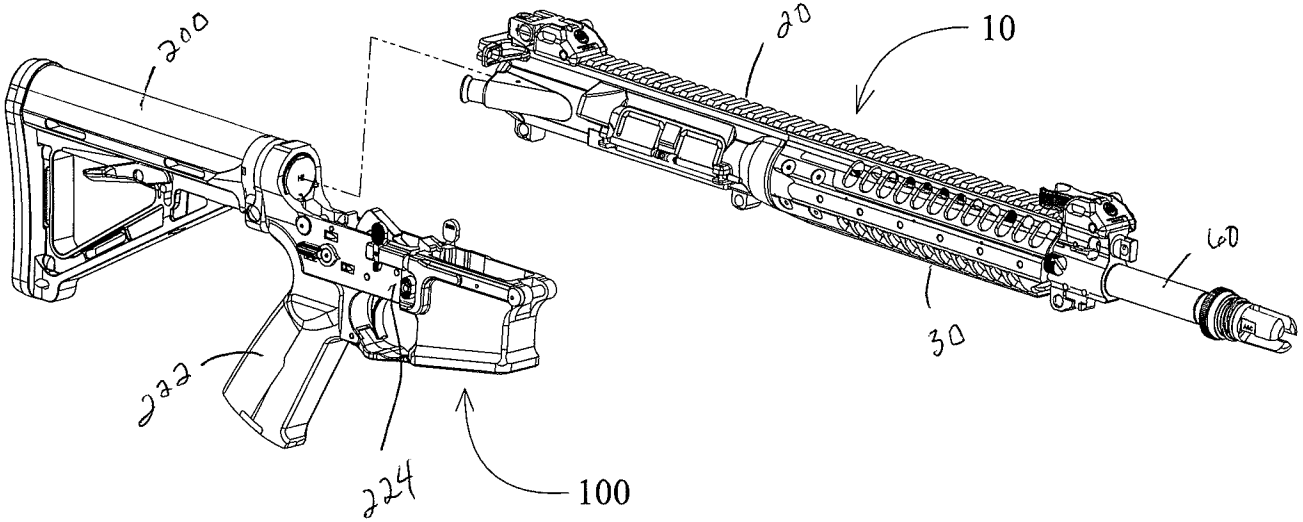
FIG. 18 is an exploded right side perspective view of a firearm including the upper receiver assembly of FIG. 1 and a lower receiver assembly.
Figure 19:
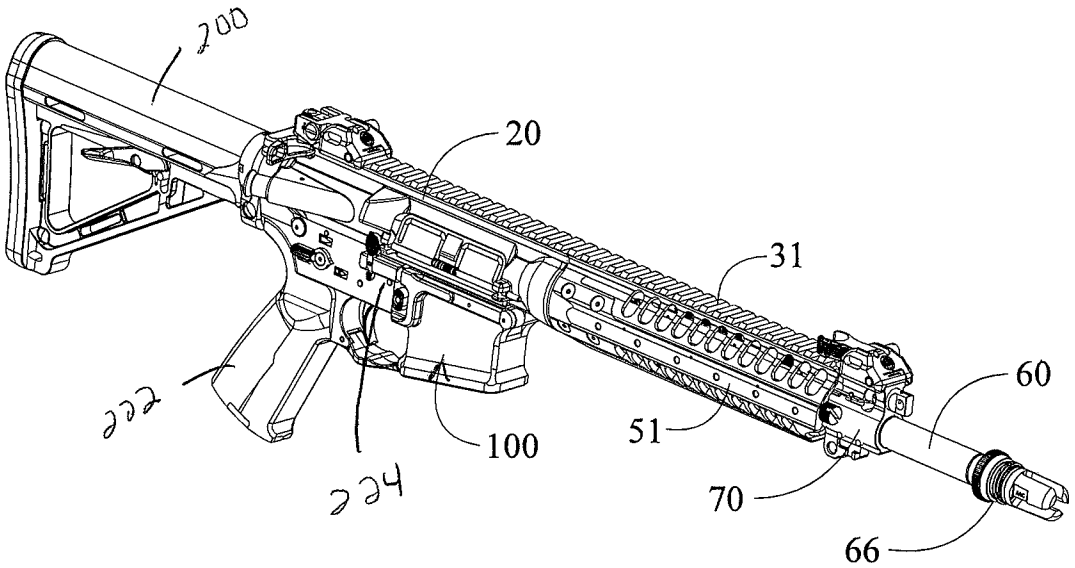
FIG. 19 is a right side perspective view of the firearm shown in FIG. 18 as assembled.
Figure 20:
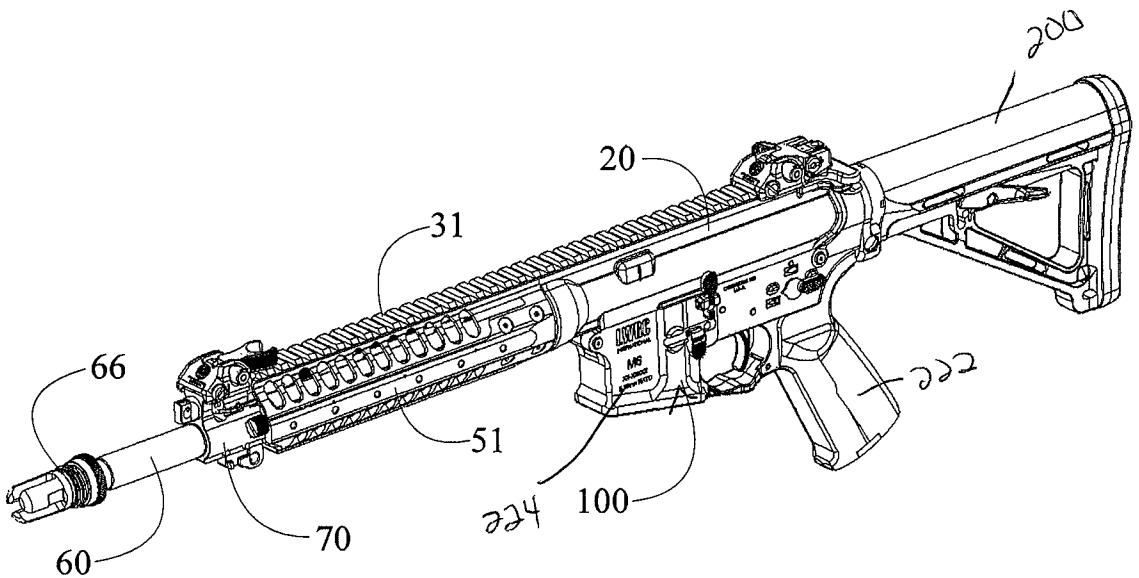
FIG. 20 is a left side perspective view of the firearm shown in FIG. 19.

FIGS. 18-20 show the receiver assembly 10 fully assembled without any rail segments 50 being attached to the handguard assembly 30. The handguard assembly 30 as disclosed herein does not directly contact the barrel 60 at any point along its length once properly installed.

When the receiver assembly 10 is assembled as described above, a bolt carrier group (well known in the prior art) is received within the interior longitudinal channel 21. The bolt carrier used will be appropriate to the specific gas operating system which was used during assembly. It should be stated that virtually any bolt carrier which works in a prior art M16/AR15 type rifle, may be received by the longitudinal channel 21 of the upper receiver 20. The receiver assembly 10 is then mated to a complete lower receiver assembly generally designated by reference numeral 100 (shown in FIGS. 18-20), consisting of a buttstock 200, pistol grip 222, lower receiver 224 and all applicable mounting hardware and required internal parts.

Thus the assembly of the new upper receiver assembly 10 has been described. By reversing the steps outlined above, the handguard assembly 30 and barrel 60 may be removed from the upper receiver 20.

CONCLUSION, RAMIFICATIONS AND SCOPE

The receiver assembly according to the present invention provides an apparatus and method for securing a barrel and handguard to the upper receiver of a firearm. The upper receiver 20 has been machined with an integral barrel nut portion which allows for direct attachment of the barrel 60 to the upper receiver 20 using only a lock nut 12. Further, the upper receiver 20 has been constructed to provide a placement 40 which acts as a support point for a portion of the gas operating system, again replacing the need for a traditional barrel nut. The receiver extension 22 allows for the removable handguard assembly 30 to be directly attached to the upper receiver 20, independently of the barrel 60 and absent the presence of a traditional barrel nut.

While the present preferred embodiment of the invention is shown and described, it is to be distinctly understood that this invention is not limited thereto but may be variously embodied to practice within the scope of the following claims. From the foregoing description, it will be apparent that various changes may be made without departing from the spirit and scope of the invention as defined by the following claims.

In an alternate embodiment, the piston assembly used with the present invention could be replaced with the direct gas impingement operating system common throughout the prior art with little modification to present design. Such a modification would not depart from the purpose and advantages offered by the upper receiver assembly 10 described herein.

In still another alternate embodiment, the handguard assembly 30 could be constructed to have integral rail portions at the 3, 6 and 9 o'clock positions, similar in construction to the rail segment 31 present on the top segment 34 of the handguard 30. This would necessarily replace the removable rail segments 50 used with the preferred embodiment without departing from the purposes and advantages offered by the herein disclosed apparatus.

In still yet another alternate embodiment, the handguard assembly 30 could be constructed as a single unit. In such an embodiment, the features of the bottom segment 32 and top segment 34 would be present on a single piece handguard which is received by the receiver extension 22. In this instance, all structural features which are present only to facilitate the attachment of the top segment 34 to the bottom segment 32 would be removed.

Accordingly, the scope of the invention should be determined not by the embodiments illustrated, but by the appended claims and their legal equivalents.

What is claimed is:

1. An upper receiver assembly for use with a gas operated firearm having a gas operating system, the upper receiver assembly comprising:

an upper receiver having a front end having an integral receiver extension extending therefrom, the receiver extension substantially shaped like a circular, elongated cylinder with a top portion of cylinder wall removed, a forward end of the receiver extension having an incomplete circular opening with a threaded interior, wherein a forward face of upper receiver includes an opening in communication with a channel that runs approximately parallel to a longitudinal axis of the upper receiver assembly, wherein the opening has a forward end and a rearward end;

a barrel directly secured to the upper receiver; and a handguard assembly directly secured to the upper receiver independently of the barrel.

2. The upper receiver assembly of claim 1, wherein the handguard assembly includes a top segment and a bottom segment, the bottom segment having a rearward end machined to receive and be directly secured to the receiver extension by fasteners configured to removably secure the bottom portion of the handguard directly to the receiver extension.

3. The upper receiver assembly of claim 2, wherein a rear portion of the bottom segment is substantially cylindrical with a correspondingly cylindrical inner bore;

a forward end of the receiver extension being received within the bottom segment cylindrical inner bore and held therein with a plurality of fasteners received within aligned openings in the receiver extension and openings in the bottom segment to removably secure the bottom segment of the handguard assembly directly to the receiver extension.

4. The upper receiver assembly of claim 2, wherein the top segment is removably coupled to the bottom segment and restrained from movement by the bottom segment.

5. The upper receiver assembly of claim 4, wherein the top segment comprises an upper surface comprising an integral rail portion.

6. The upper receiver assembly of claim 5, wherein the rail portion comprises multiple rails separated by traverse grooves there between.

7. The upper receiver assembly of claim 3, wherein the bottom portion comprises a front portion angled to reduce weight of the handguard.

8. The upper receiver assembly of claim 7, wherein the front portion comprises two receptacles, and two pusher screws received in each receptacle, wherein each pusher screw is retained by at least one c-clip and o-ring, and wherein each pusher screw is textured and of size to be gripped and rotated.

9. The upper receiver assembly of claim 3, wherein the bottom segment comprises a rear portion with an opening into an interior of the bottom segment, wherein the opening is generally circular in shape with an apex of the opening removed.

10. The upper receiver assembly of claim 9, wherein the opening into the interior of the bottom segment is adjacent to a bore that defines a portion of the bottom segment's interior, wherein the bore comprises a rearward end by the opening and a forward end defined by an approximately semi-circular bearing surface.

11. The upper receiver assembly of claim 1, wherein the barrel has an annular flange about its back end; and wherein the upper receiver assembly further comprises a lock nut fitted around a portion of the barrel.

12. The upper receiver assembly of claim 1, wherein the barrel includes a front end and a back end, the barrel including an annular flange about a portion of the back end of the barrel, and wherein the back end of the barrel is received in the opening of the forward end of the receiver, the forward end having a bearing surface against which the annular flange of the barrel rests; and the upper receiver assembly further including a lock nut encircling a portion of the barrel between the annular flange and the front end of the barrel, wherein an outer surface of the lock nut includes a first threaded portion, and wherein an inner surface of the receiver extension includes a second threaded portion configured to cooperate with the first threaded portion of the outer surface of the lock nut to threadedly secure the lock nut to the received extension such that the annular flange is secured against the bearing surface thereby mounting the barrel directly to the receiver extension of the upper receiver.

13. The upper receiver assembly of claim 1, wherein the opening is wider at the forward end and gradually tapers down in diameter along its length towards the rearward end.

14. A gas operated firearm having the upper receiver assembly of claim 13, the gas operated firearm further comprising:

the gas operating system.

15. The gas operated firearm of claim 14, wherein the opening provides an entry for a portion of the gas operating system into the channel.

16. The gas operated firearm of claim 14, wherein the opening in the receiver extension is machined to support a portion of the gas operating system.

* * * * *